US007566060B1

(12) United States Patent
Breslow et al.

(10) Patent No.: US 7,566,060 B1
(45) Date of Patent: Jul. 28, 2009

(54) TARGET GAME

(75) Inventors: Jeffrey D. Breslow, Chicago, IL (US); Zarko Stambolic, Oak Park, IL (US); Karl R. Meyer, South Hadley, MA (US)

(73) Assignee: Big Monster Toys, LLC, Chicago, IL (US)

( * ) Notice: Subject to any disclaimer, the term of this patent is extended or adjusted under 35 U.S.C. 154(b) by 364 days.

(21) Appl. No.: 11/535,048

(22) Filed: Sep. 25, 2006

Related U.S. Application Data

(63) Continuation-in-part of application No. 10/720,480, filed on Nov. 25, 2003, now Pat. No. 7,111,846.

(51) Int. Cl.
*A63F 7/00* (2006.01)

(52) U.S. Cl. ..... 273/342; 273/352; 273/371

(58) Field of Classification Search ..... 273/342, 273/348, 352, 371, 398, 399, 400, 401, 402
See application file for complete search history.

(56) References Cited

U.S. PATENT DOCUMENTS

| | | | |
|---|---|---|---|
| 1,313,783 | A | 8/1919 | Blackburn |
| 2,806,701 | A | 9/1957 | Durant |
| 2,926,915 | A | 3/1960 | Johns |
| 3,368,814 | A | 2/1968 | Kolwicz |
| 3,689,069 | A | 9/1972 | Rogers |
| 3,782,729 | A | 1/1974 | Ernst |
| 3,818,628 | A | 6/1974 | Ensmann et al. |
| 3,837,648 | A | 9/1974 | Breslow |
| 4,119,311 | A | 10/1978 | Jenkins et al. |
| 4,210,328 | A | 7/1980 | Meintzer et al. |
| 5,007,638 | A | 4/1991 | Yukl |
| 5,031,919 | A | 7/1991 | Dixon |
| 5,423,552 | A | 6/1995 | English |
| 5,566,948 | A | 10/1996 | Kidd |
| 5,577,733 | A | 11/1996 | Downing |
| 5,613,922 | A | 3/1997 | Hsiang |
| 5,658,211 | A | 8/1997 | Glover |
| 5,697,611 | A | 12/1997 | Kelley et al. |
| 5,713,575 | A | 2/1998 | Angelucci |
| 5,769,424 | A | 6/1998 | Kelley et al. |
| 5,967,911 | A | 10/1999 | Mcavoy |
| 6,267,378 | B1 | 7/2001 | Kanbar |
| 6,474,651 | B1 | 11/2002 | Rivera |
| 6,502,819 | B2 | 1/2003 | Rieber et al. |
| 7,111,846 | B1 | 9/2006 | Breslow et al. |

*Primary Examiner*—Raleigh W. Chiu
(74) *Attorney, Agent, or Firm*—Fish & Richardson P.C.

(57) ABSTRACT

A game includes a base unit, a target area, a launch area, and an electronic controller. The target area is attached to the base unit and has multiple target sections. The launch area is attached to the base and is configured for bouncing a playing piece into one of the multiple target sections. The electronic controller is configured to monitor the target sections and control game play. For two person play, the game may have two launch areas and the target area may be divided into two target regions.

20 Claims, 19 Drawing Sheets

TARGET GAME

CLAIM OF PRIORITY

This application is a continuation-in-part of U.S. patent application Ser. No. 10/720,480, filed on Nov. 25, 2003, and titled "Target Game," the entire contents of which are hereby incorporated by reference.

TECHNICAL FIELD

This description relates to a target game.

BACKGROUND

Target games which provide a playing piece that is projected toward a target are generally known. In such a game, a player hits a target with a playing piece to score points.

SUMMARY

Described is a game including a base unit, a target area, a first launch area, a second launch area, a detection system, and an electronic controller. The target area is attached to the base unit and has multiple target sections. Each target section includes an aperture. The first launch area is attached to the base and adapted for receiving a first playing piece tossed onto the first launch area by a user such that the first playing piece bounces into one of the multiple target sections and passes through the corresponding aperture of the target section. The second launch area is attached to the base and adapted for receiving a second playing piece tossed onto the second launch area by a user such that the second playing piece bounces into one of the multiple target sections and passes through the corresponding aperture of the target section. The detection system is configured to detect which one of the apertures the first playing piece passed through and which one of the apertures the second playing piece passed through. The electronic controller is configured to receive one or more signals from the detection system and to control game play based on the one or more signals. The one or more signals received by the electronic controller indicate which aperture the first playing piece passed through and which aperture the second playing piece passed through.

Implementations may include one or more of the following features. For example, the multiple target sections may be arranged in a first target region and a second target region. In this arrangement, the first launch area may be adapted for receiving the first playing piece tossed onto the first launch area by a user such that the first playing piece bounces into one of the multiple target sections in the first target region, and the second launch area may be adapted for receiving the second playing piece tossed onto the second launch area by a user such that the second playing piece tossed onto the second launch area bounces into one of the multiple target sections in the second target region.

The target area may include a series of concentric, upstanding, circular walls, each circular wall defining one of the multiple target sections, and the base unit, the target area, the first launch area and the second launch area may be sized for table-top play of the game.

The electronic controller may be configured to control game play according to a game mode selected by a player of the game. In this configuration, the game may include an input operatively connected to the electronic controller to allow the player to select one of at least two game modes. Each of the two game modes may have a different objective for game play.

In another example, a game may include a base unit, a first target region, a second target region, a first launch area, a second launch area, a detection system, and an electronic controller. The first target region is attached to the base unit and includes a first set of multiple target sections. Each target section in the first set includes an aperture. The second target region is attached to the base unit and includes a section set of multiple target sections. Each target section in the second set includes an aperture. The first launch area is attached to the base unit and adapted for receiving a first playing piece tossed onto the first launch area by a user such that the first playing piece bounces toward the first target region. The second launch area is attached to the base unit and adapted for receiving a second playing piece tossed onto the second launch area by a user such that the second playing piece bounces toward the second target region. The detection system is configured to detect when the first playing piece passes through one of the apertures in the first target region and to detect when the second playing piece passes through one of the apertures in the second target region. The electronic controller is configured to receive one or more signals from the detection system and to control game play based on the one or more signals. The one or more signals received by the electronic controller indicate when the first playing piece passes through one of the apertures in the first target region and when the second playing piece passes through one of the apertures in the second target region.

Implementations may include one or more of the following features. For example, the first target region may include a series of concentric, upstanding, circular walls. Each circular wall may define one of the multiple target sections in the first set. The second target region may include a series of concentric, upstanding, circular walls. Each circular wall may define one of the multiple target sections in the second set.

The game may include an input configured to allow a player to select one of at least two game modes. Each of the two game modes may have a different objective for game play. For example, each one of the target sections may be assigned a point value and the objective of one of the at least two game modes is for a first player to lead a second player by a specified number of points. The objective of one of the at least two game modes may be to bounce a playing piece into a target section selected by the controller, to obtain points by hitting a selected one of the target regions, to bounce a playing piece into a particular target section to obtain control of the game and, while in control, to obtain points by bouncing a playing piece into one of the target sections, or to bounce multiple playing pieces into a selected combination of the target sections.

The first launch area, the second launch area, the first target region, and the second target region may be arranged such that a path of the first playing piece bounced from the first launch area toward the first target region crosses the path of the second playing piece bounced from the second launch area toward the second target region. For example, the first launch area may be positioned diagonally cross from the first target region and the second launch area may be positioned diagonally across from the second target region such that a path between the first launch area to the first target area crosses a path between the second launch area and the second target region.

Other features will be apparent from the following description, including the drawings, and from the claims.

DETAILED DESCRIPTION

Figure 1:
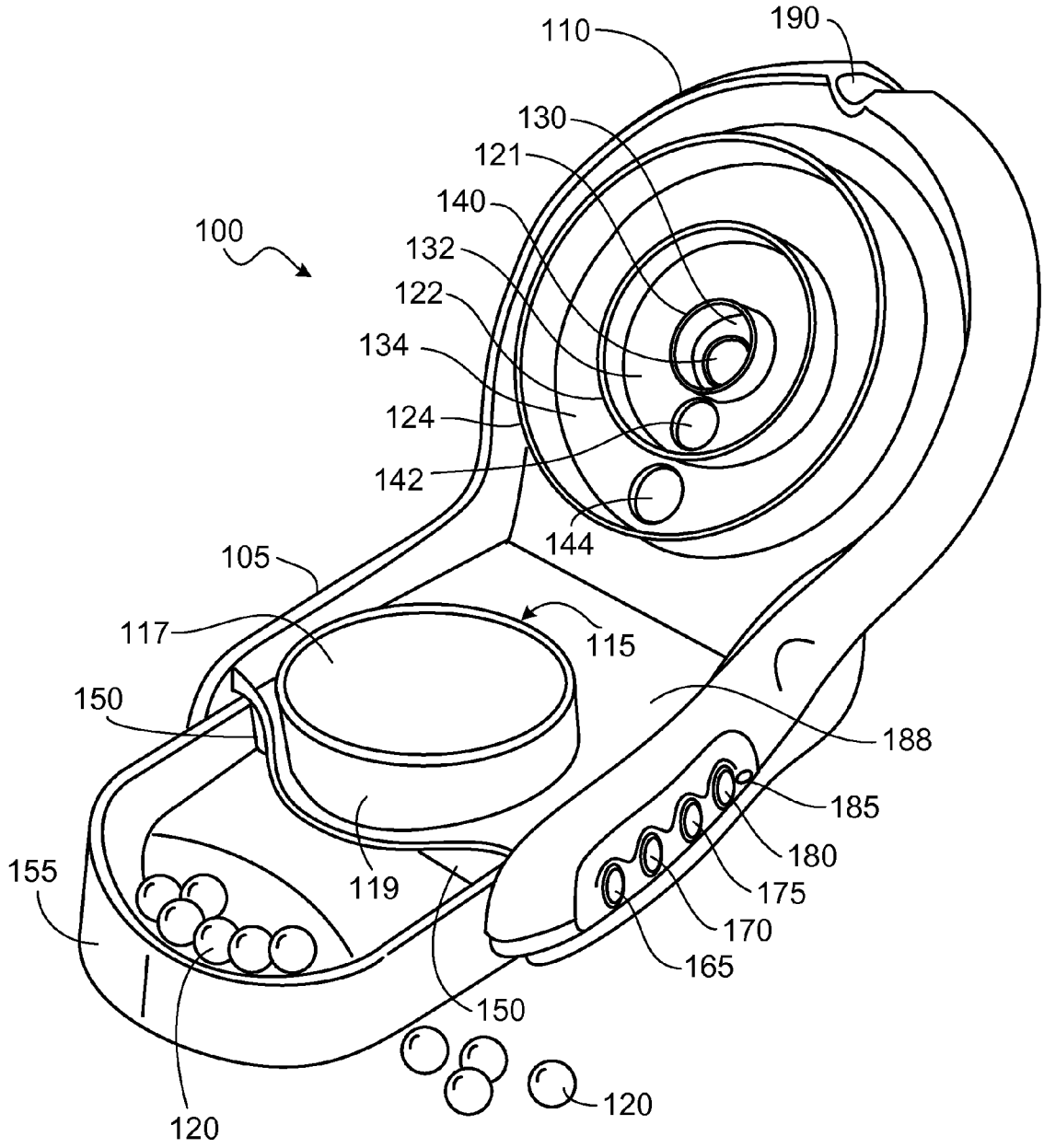
FIG. 1 is a perspective view of a top portion of a target game.
Figure 2:
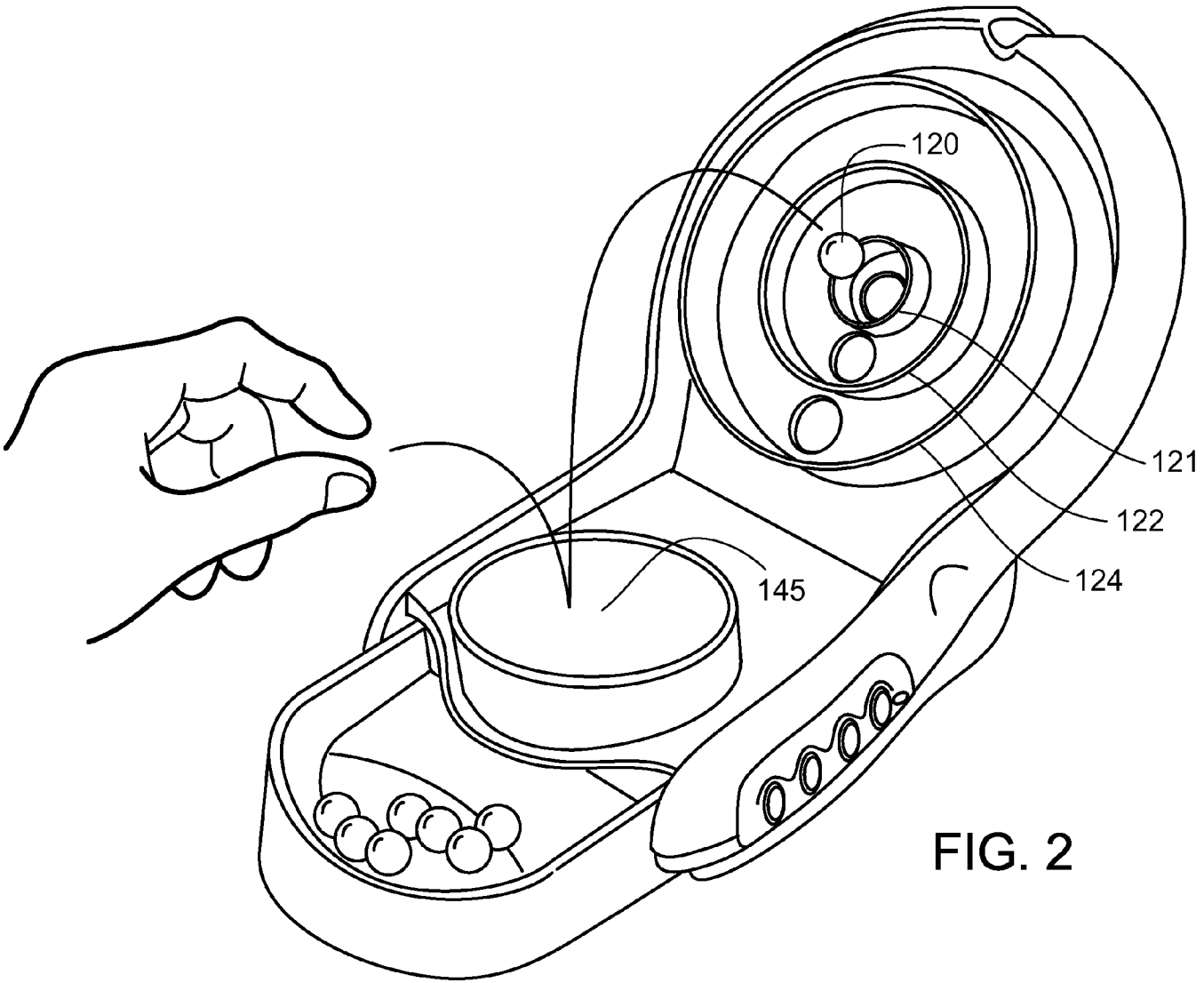
FIG. 2 is a perspective view showing general use of the target game by a user.

Referring to FIGS. 1 and 2, a target game 100 includes a base 105, a target area 110, and a launch area 115. The target area 110 is attached to the base 105 such that the target area 110 and the base 105 define an obtuse angle. The target area 110 includes a series of concentric, upstanding, circular walls 121, 122, and 124 that define, respectively, target sections 130, 132, and 134. Each of the target sections 130, 132, and 134 includes a corresponding aperture 140, 142, or 144. The base unit 105 and target area 110 are made of plastic or other suitable rigid materials.

The base 105 includes a surface 188 in front of the target area 110 to which the launch area 115 is attached. The launch area 115 includes an elastic material 117, such as rubber or nylon, stretched over a plastic ring 119 to form, in effect, a trampoline.

The game 100 also includes playing pieces 120. Playing pieces 120 are made of a firm material, such as metal or plastic, that can be bounced off the elastic launch area 115 into the target area 110.

The game 100 may be sized for table-top play such that, for example, the overall size is less than 2 feet long, less than 1 foot high, and less than 1 foot wide. In one implementation, the game 100 is approximately 12 inches long, approximately 5 inches wide, and approximately 6.5 inches high.

Referring particularly to FIG. 2, game play generally entails bouncing the playing pieces 120 from the launch area or trampoline 115 into the target area 110. In one implementation, a player receives a set number of points for hitting one of the target sections 130, 132, and 134 with a playing piece 120, with the points varying according to which target section is hit. Higher points can be assigned for smaller target sections. For example, in one implementation, the player receives three points for hitting the center section 130, two points for hitting the middle section 132, and one point for hitting the outer section 134.

After a playing piece 120 strikes a target section 130, 132, or 134, the wall 121, 122, or 124 defining the target section guides the playing piece 120 into the corresponding aperture 140, 142, or 144. For instance, after a playing piece 120 strikes target section 132, the wall 122 guides the playing piece 120 into aperture 142.

Figure 3:
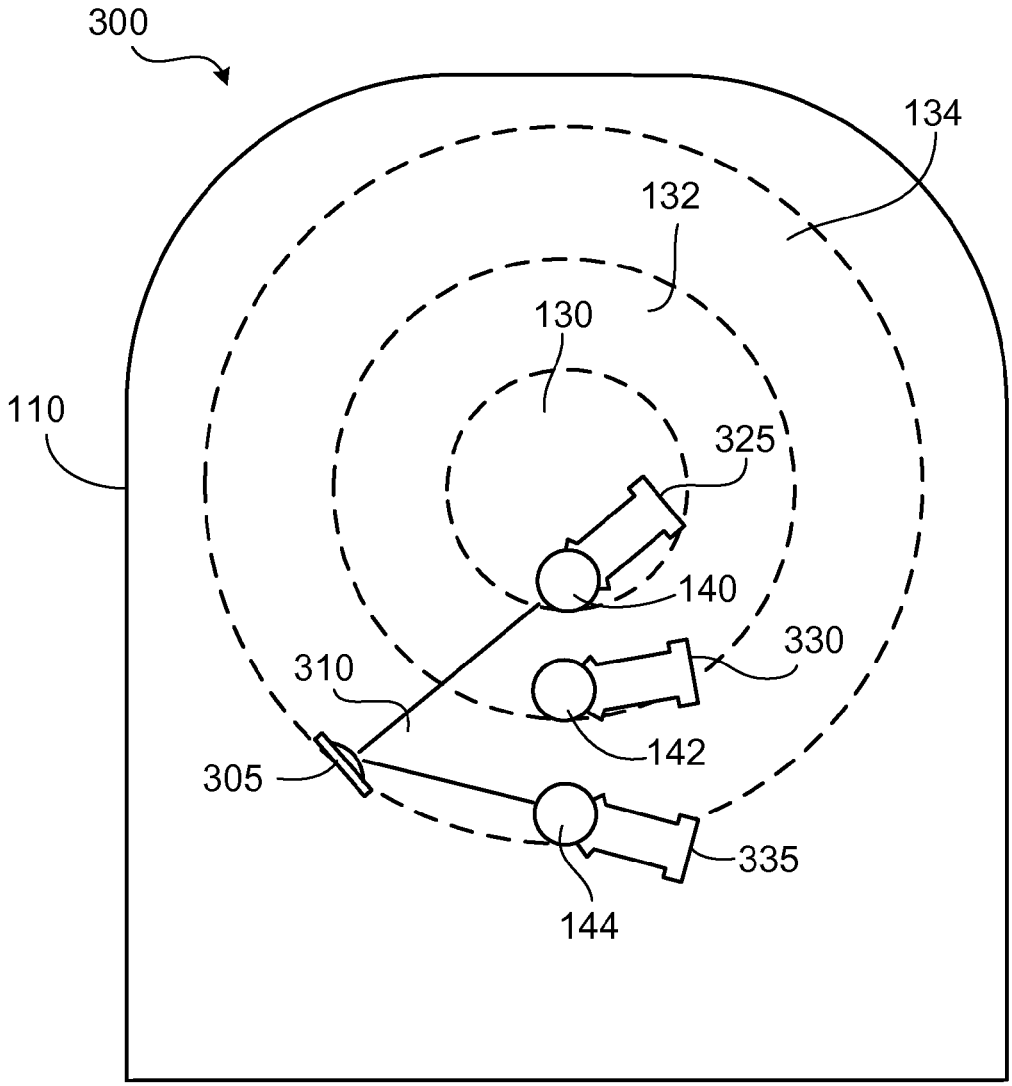
FIG. 3 is a plan view showing an optical detection system of the target game.

Referring to FIG. 3, an optical sensor system 300 detects the passage of playing pieces 120 through the apertures 140, 142, and 144, and provides signals used by the game 100 to increase the score accordingly. The optical sensor system 300 includes an optical emitter 305 (e.g., an infrared light emitter) that emits an optical (e.g., infrared) beam 310 toward three optical (e.g., infrared) detectors 325, 330, and 335 that detect the presence of the beam 310. Each optical detector 325, 330, or 335 is positioned next to a corresponding apertures 140, 142, and 144 on the opposite side from the emitter 305. The passage of a playing piece through an aperture 140, 142, or 144 momentarily interrupts the beam 310. This momentary interruption is detected by the detector 325, 330, or 335 that is located next to the aperture 140, 142, or 144 through which the playing piece 120 passed. The corresponding detector 325, 330, or 335 then signals the game 100 to increase the score.

Game 100 also includes a passage 150 and a tray 155 that are attached to the base 105 such that tray 155 engages passage 150. Passage 150 also is connected to the apertures 140, 142, and 144. As a result, playing pieces 120 that enter the apertures 140, 142, and 144 move through the passage 150 to the tray 155. The tray 155 holds playing pieces 120 during game play and may include a cover (not shown) to hold pieces securely while the game is not in use.

In the event that a playing piece misses a target section 130, 132, or 134, the playing piece 120 may fall back and strike surface 188. Surface 188 is oriented so that the playing piece that misses the target sections 130, 132, and 134 and falls back to strike the surface 188 will return to the tray area 155.

The game 100 also includes control buttons 165-185 located on the base 105. The control buttons 165-185 allow a player to control aspects of the game 100. The ON/GAME button 165 activates the game when initially pressed and is used subsequently to select one of several game modes (which are further described below) for play. Pressing the SCORE button 170 causes the score to be announced. Pressing the SOUND button 175 adjusts the speaker volume. Pressing the OFF button 180 turns the game off. Pressing the RESET button 185 erases the game's memory of any best scores and times (described below).

Figure 4:
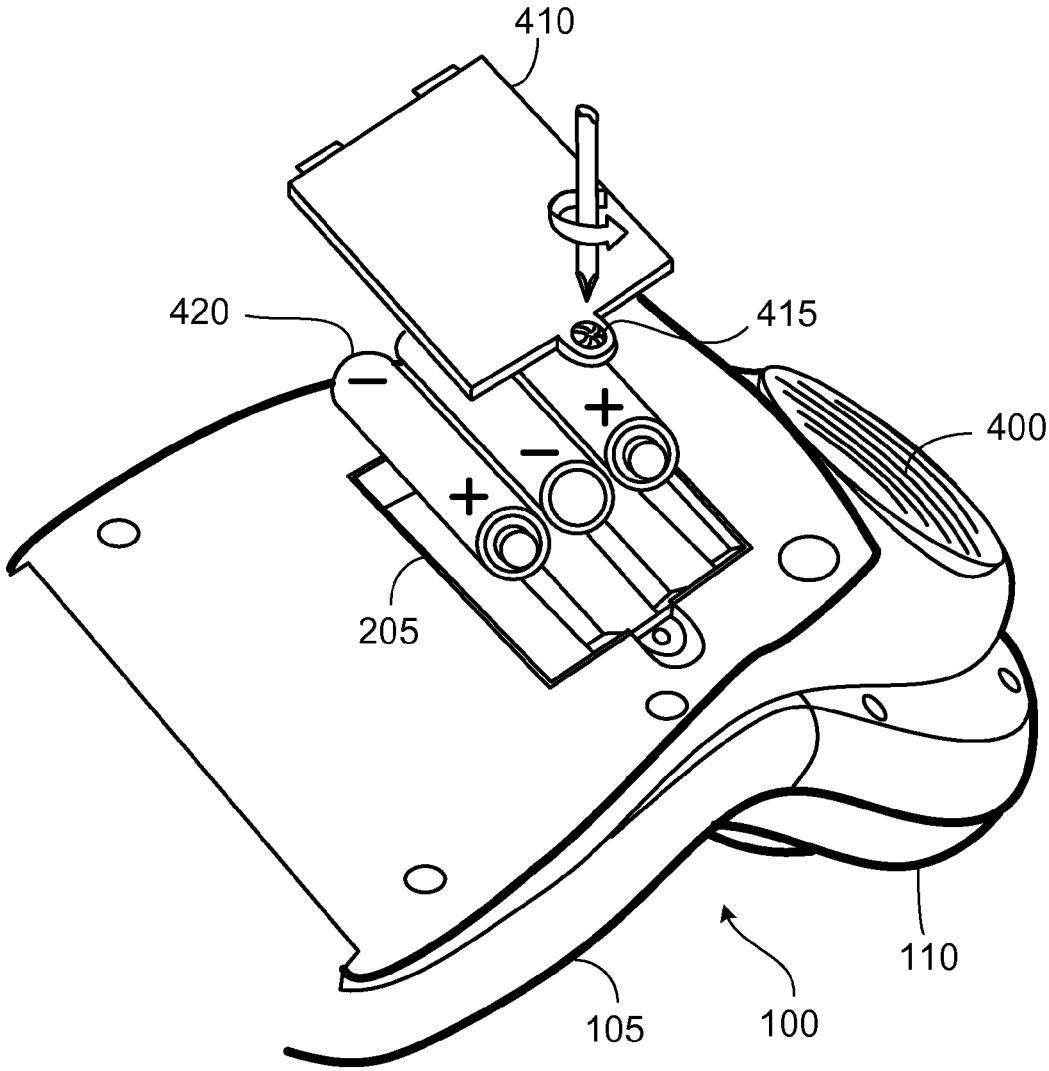
FIG. 4 is a perspective view of a bottom portion of the target game.

The game 100 further includes a visual feedback mechanism in the form of a light 190 (or, in other implementations, an alphanumeric display) mounted at the top of the target area 110. Referring also to FIG. 4, the game 100 also includes a speaker 400 that is mounted at the back of the target area 110. The speaker 400 (or other audio feedback mechanism) is used to emit voice, music, or other sounds. These audio and visual feedback mechanisms are used to inform the player of certain aspects of the game, such as game mode selection, current time or score, or best time or score.

As shown in FIG. 4, the underside of the base 105 includes a power source compartment 405 that is closed by a cover 410 and secured in place by a screw 415. The compartment 405 holds batteries 420. In other implementations, the base includes a port (not shown) to which an external power source is connected.

Figure 5:
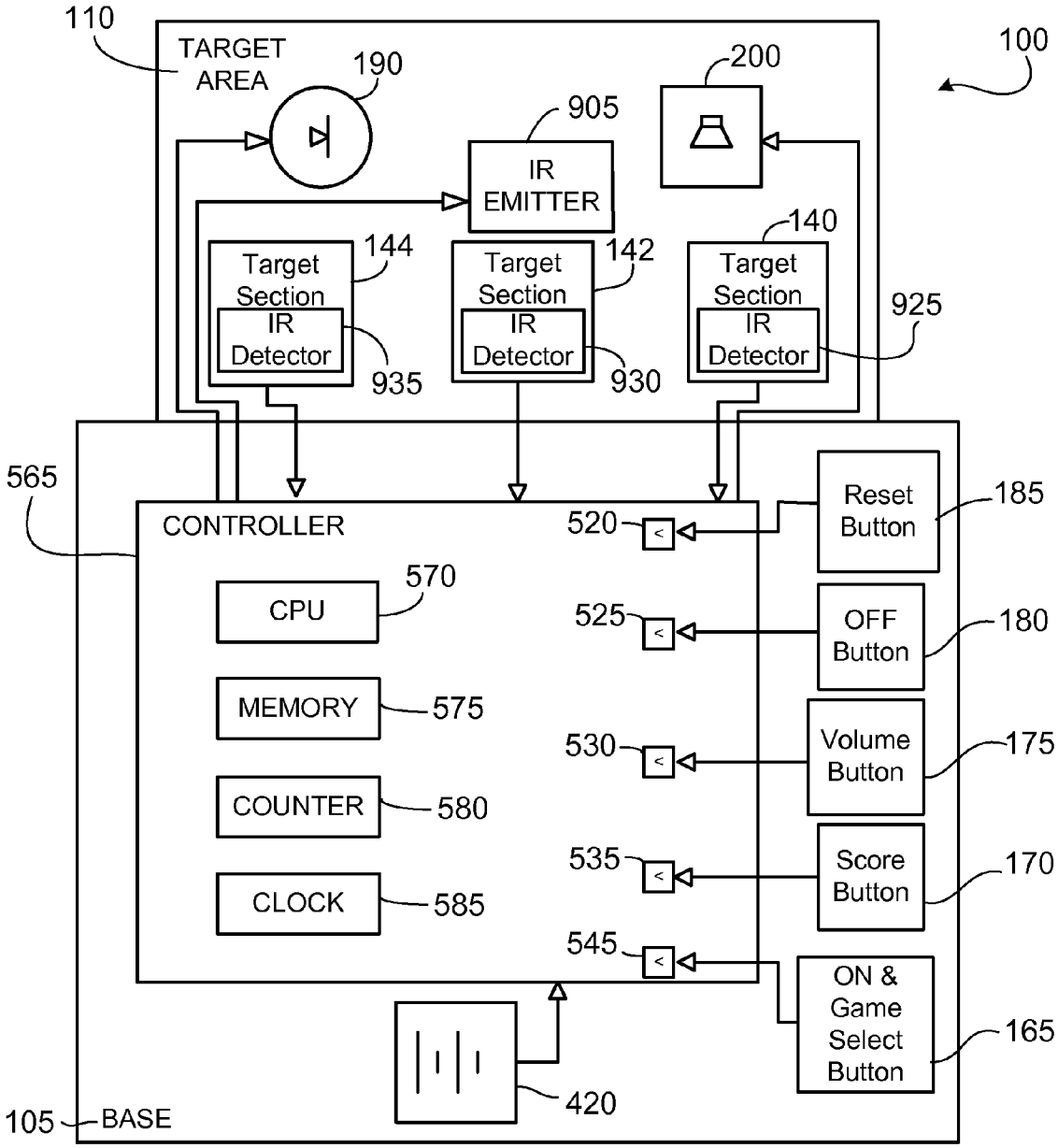
FIG. 5 is a schematic diagram of the target game's electrical system.

Referring to FIG. 5, a control system provides electrical power and control of the game 100. A controller 565 is housed inside the base 105 and includes a processor 570, a memory 575, a counter 580, and a clock 585. The controller 565 receives inputs from the control buttons 165-185 and corresponding switches 520-545 and the optical detectors 325-335. The controller 565 receives power from the power source 420. The controller 565 uses the inputs from control buttons 165-185 and optical detectors 325-335 to control game play and to produce outputs that control the optical emitter 305, the speaker 400, and the light 190.

Figure 6:
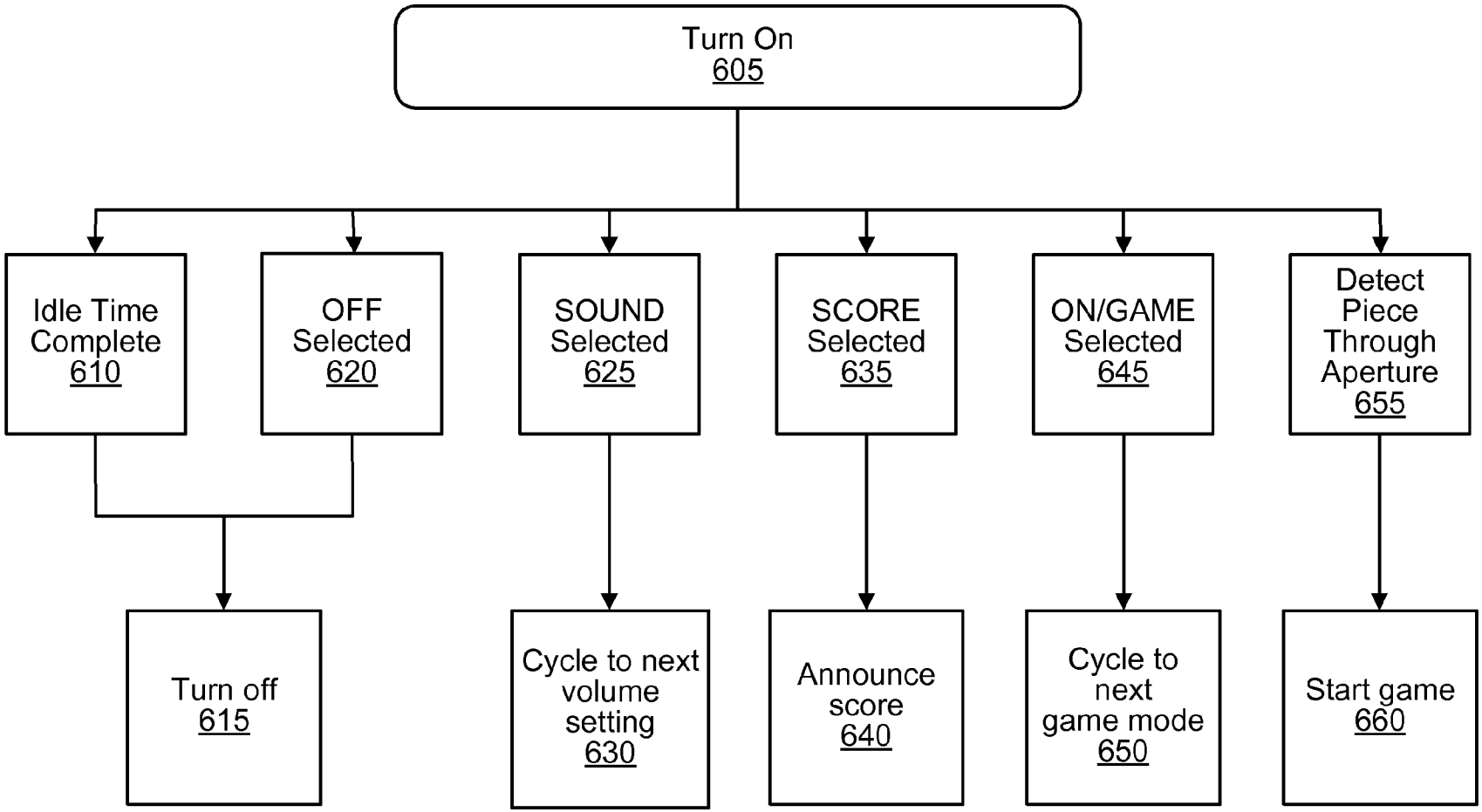
FIGS. 6-9 are a flow charts showing procedures implemented by a controller of the target game.

Referring to FIG. 6, the controller 565 implements a procedure 600 to control game play. Initially, the game is turned on (step 605) when the ON/GAME button 165 is pressed. The controller 565 determines if any of the switches 520-545 or optical detectors 325-335 has been activated within a set amount of time (for example, 60 seconds) (step 610) and, if not, the controller 565 causes the game to automatically turn off (step 615). Similarly, if the OFF button is pressed (step 620), the controller 565 causes the game to turn off (step 615).

When the SOUND button 175 is selected (step 625), the controller 565 cycles to the next volume level (step 630). The volume levels include, for example, high, low, and off.

When the SCORE button 170 is selected (step 635), the controller causes the score of the most recent game played to be announced by speaker 200 (step 640).

When the ON/GAME button 165 is selected (step 645), the controller 565 cycles to the next game mode (650). Game 100 includes four game modes, a 30-SECOND BLITZ game mode, a 25-POINT RUSH game mode, a BULLS-EYE ACE game mode, and a PRACTICE game mode. The objective of the 30-SECOND BLITZ game mode is to score the most points in a predetermined time period, e.g. 30 seconds. The objective of the 25-POINT RUSH game mode is to score twenty-five points in the least amount of time. The objective of the BULLS-EYE ACE game mode is to score the most bulls-eyes by hitting the center target section 130 before missing the center target section 130 a set number of times, e.g. ten times. Lastly, the PRACTICE game mode allows a player to bounce playing pieces 120 at the target area 110 with no limits on time, number of balls, or misses.

When an optical detector 325, 330, or 335 signals to controller 565 that a playing piece 120 has passed through an aperture 140, 142, or 144 (step 655), then a game according to the presently selected game mode is initiated (step 660).

Figure 7:
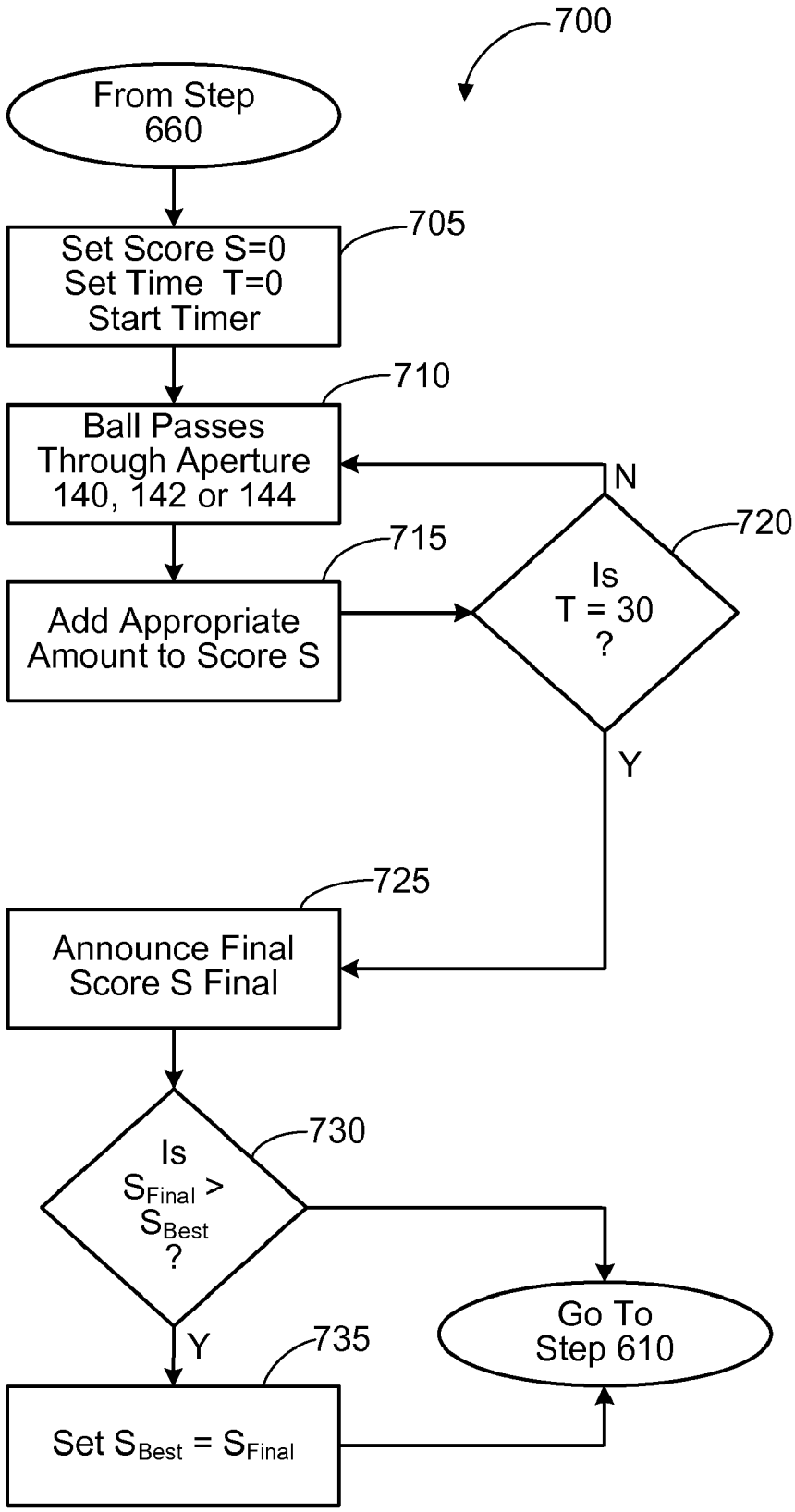

Referring to FIG. 7, a process 700 is performed by controller 565 to implement the 30-SECOND BLITZ game mode. Initially, a score S and a time T are set to zero and a timer is started (step 705). If an optical sensor 325, 330, or 335 indicates a playing piece 120 has passed through an aperture 140, 142 or 144 (step 710), the appropriate amount (e.g., 3 points, 2 points, or 1 point), is added to the score S (step 715). The game continues until the time T has reached thirty seconds (step 720). At that point, the final score SFINAL is announced (step 725) and, if SFINAL is greater than the best score SBEST (step 730), SFINAL is recorded as the new SBEST (step 735).

Figure 8:
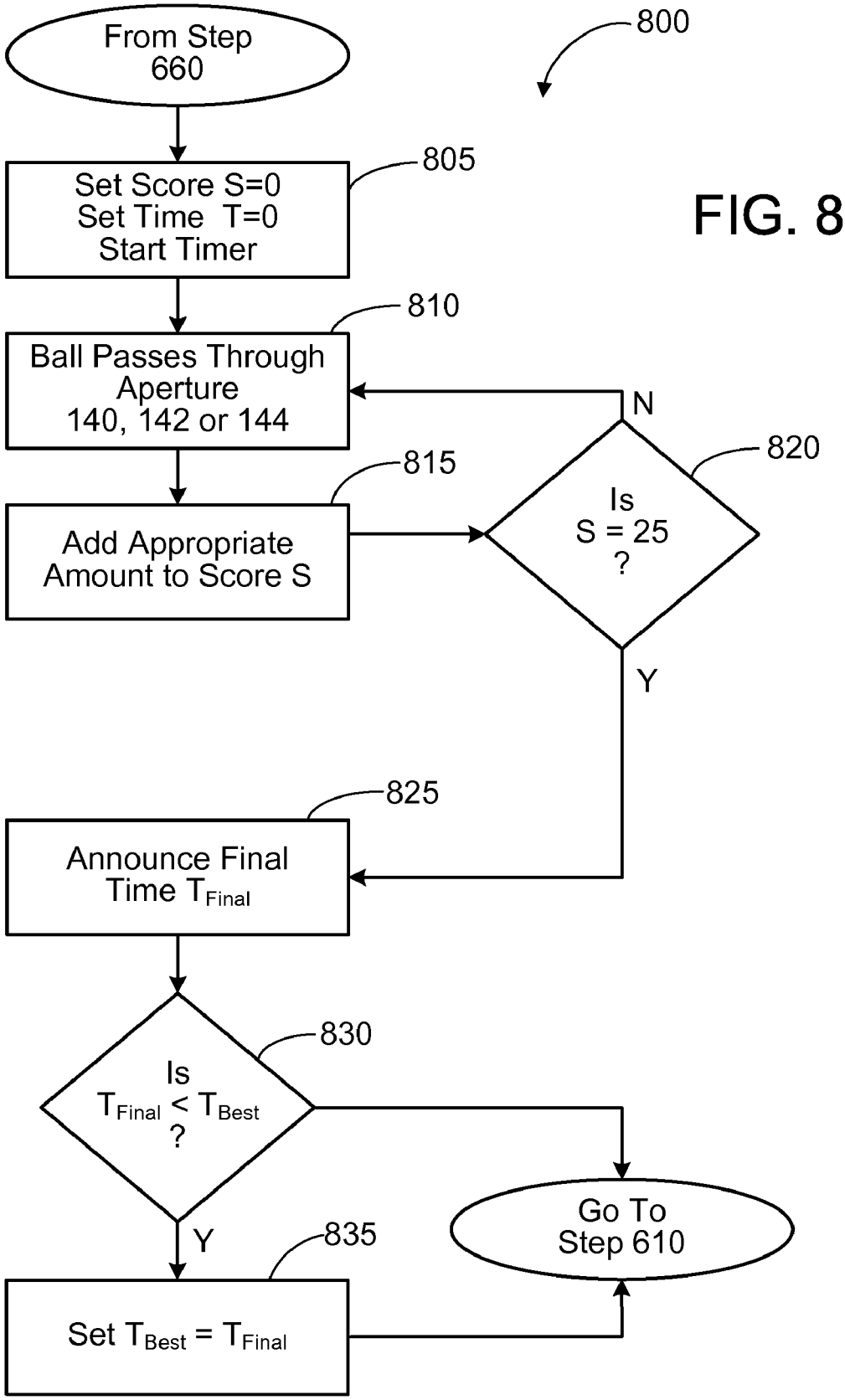

Referring to FIG. 8, a process 800 is performed by controller 565 to implement the 25-POINT RUSH game mode. When the game starts, the score S and the time T are set to zero and the timer is started (step 805). If an optical sensor 325, 330, or 335 indicates a playing piece 120 has passed through an aperture 140, 142 or 144 (step 810), the appropriate amount (e.g., 3 points, 2 points, or 1 point) is added to the score S (step 815). The game continues until the score S has reached twenty-five points (step 620). At that point, the final time TFINAL is announced (step 825) and, if TFINAL is less than the best time TBEST (step 830), TFINAL is recorded as the new TBEST (step 835).

Figure 9:
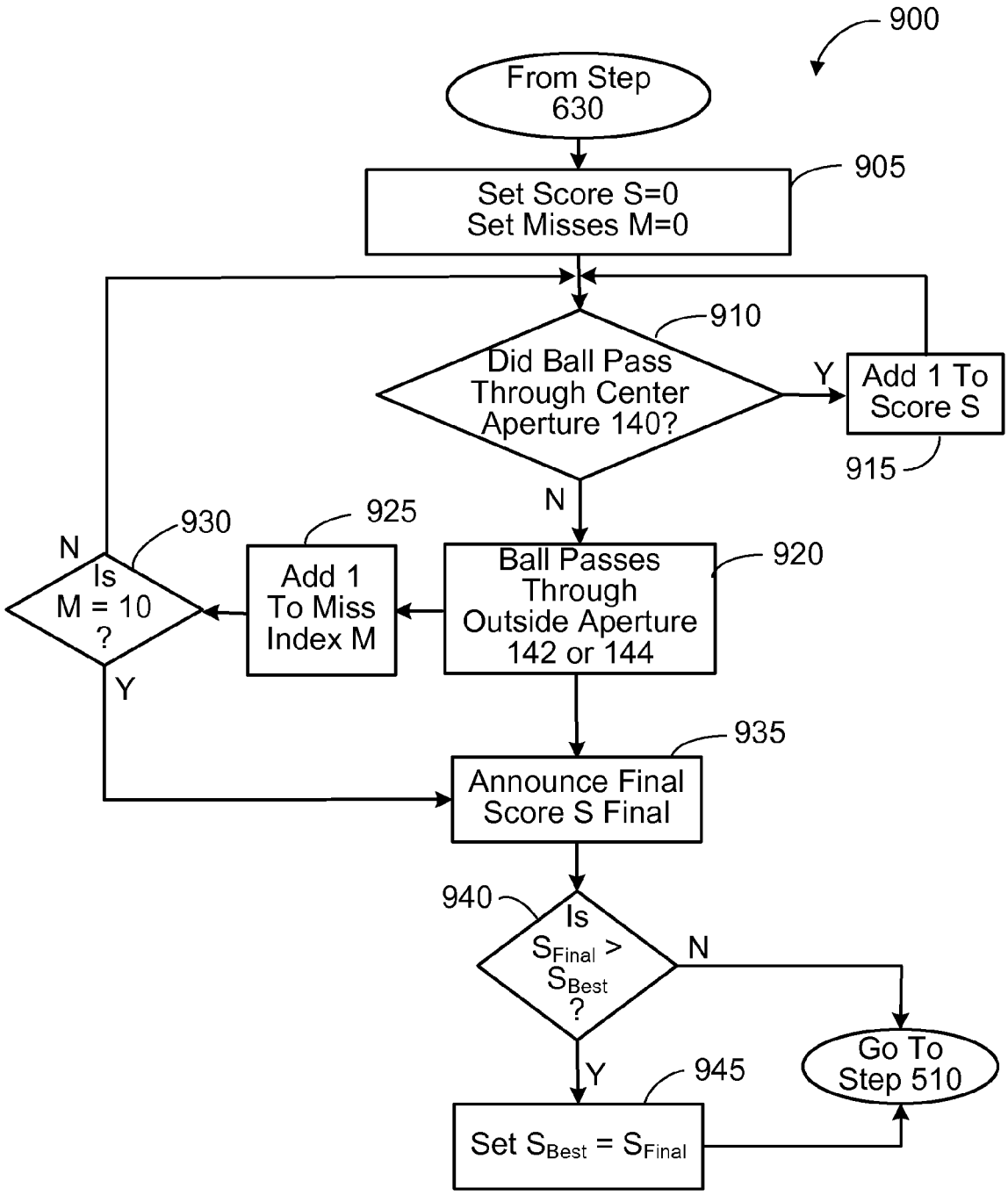
Figure 10:
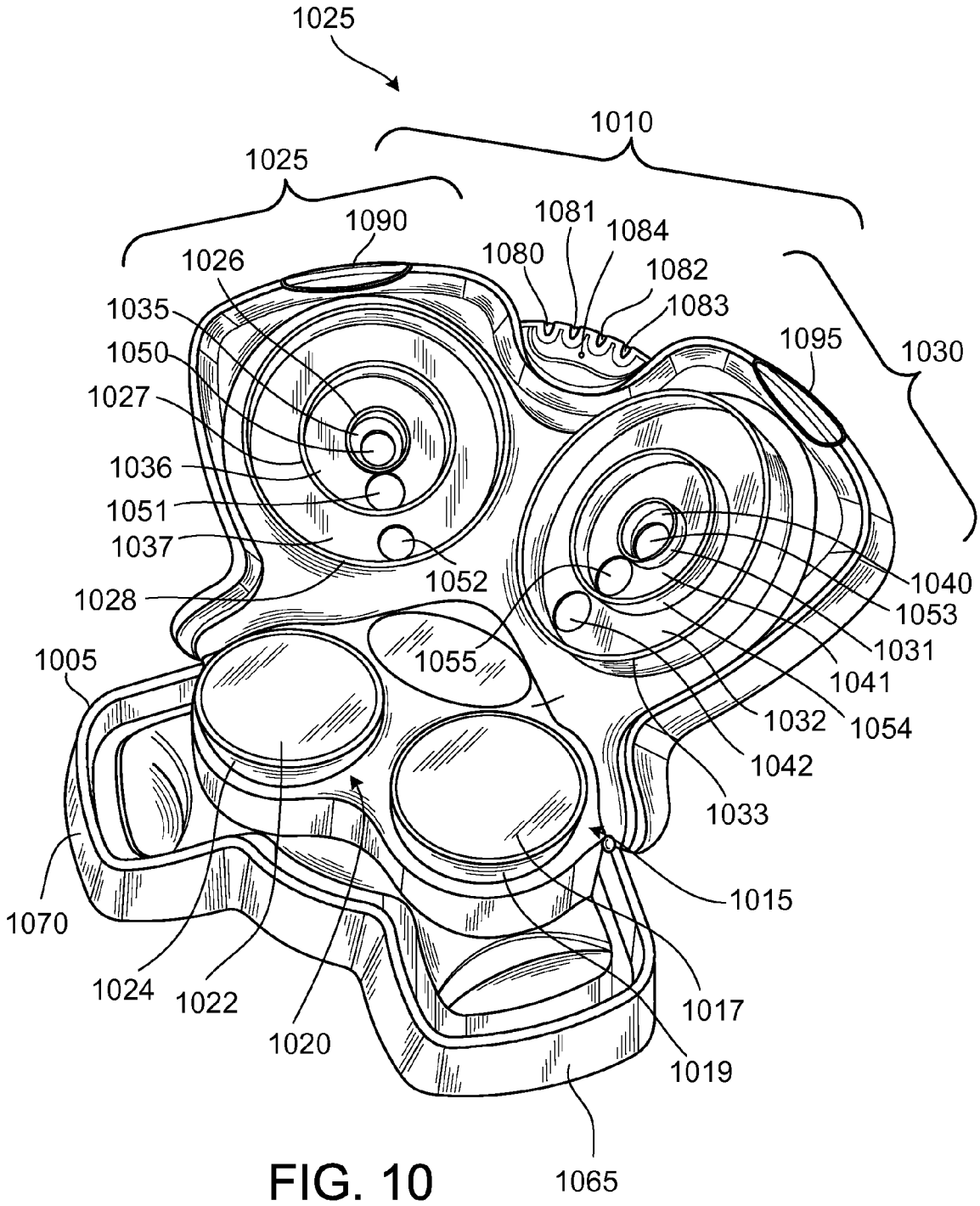
FIGS. 10-13, collectively, illustrate another implementation of a target game.
Figure 11:
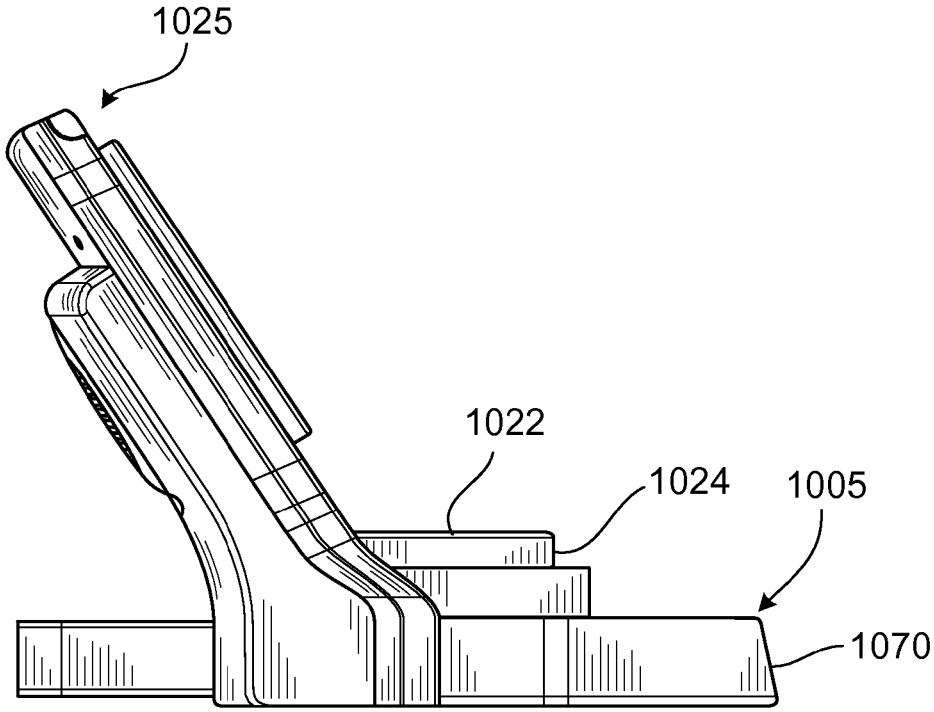
Figure 12:
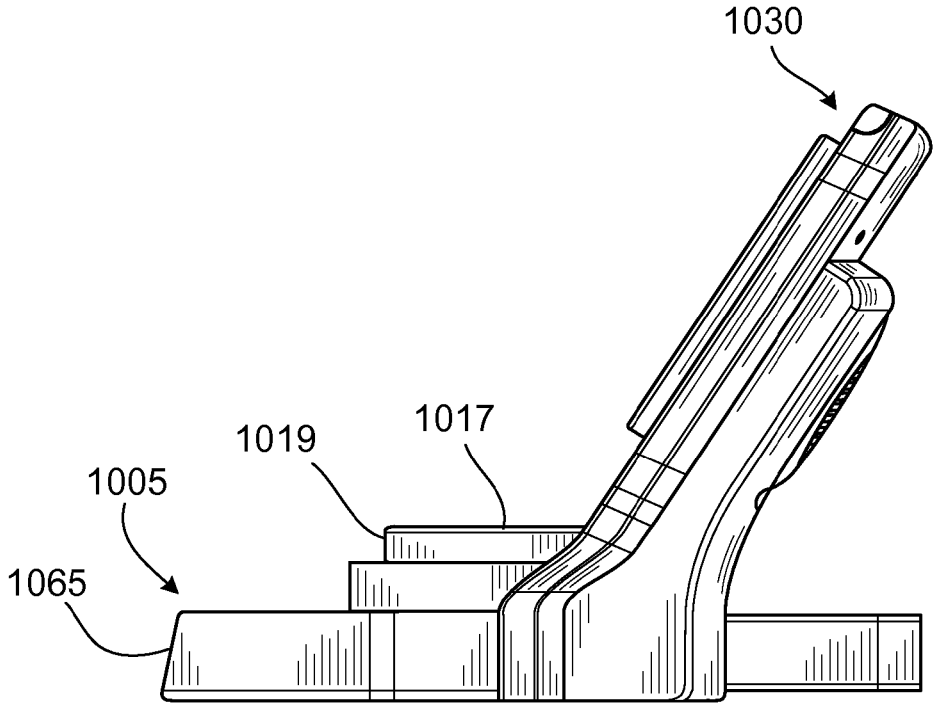
Figure 13:
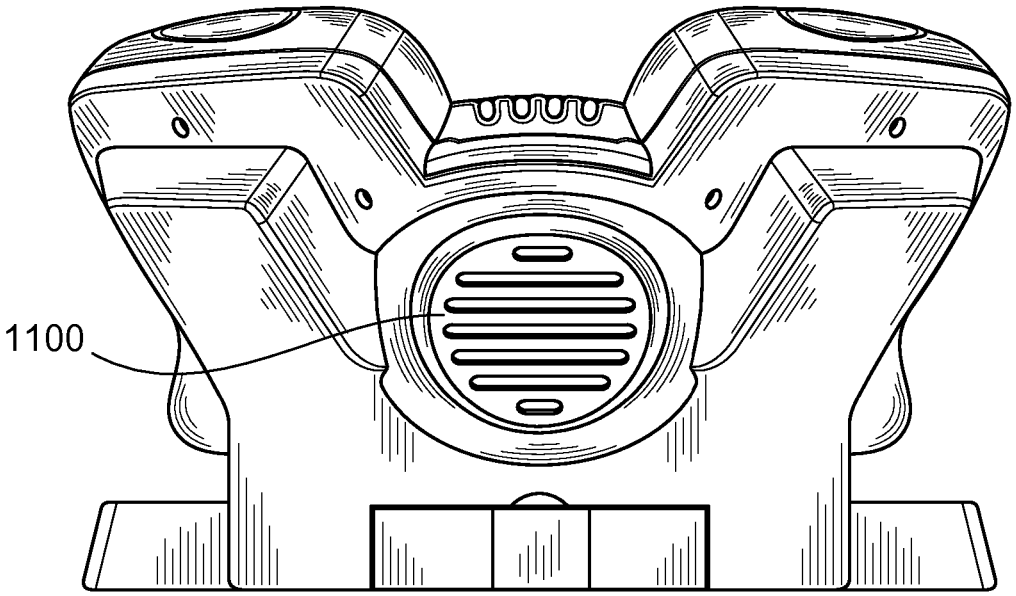

Referring to FIG. 9, a process 900 is performed by controller 565 to implement the BULLS-EYE ACE game mode. Initially, the score S and a miss index M are set to zero (step 905). If a ball passes through the center aperture 140 (step 910), one is added to the score S (step 915). If a ball passes through one of the two outside apertures 143 or 144, one is added to the miss index M (step 925). Play continues until the miss index M reaches 10 (step 930). At that point, the final score SFINAL is announced (step 935) and, if SFINAL is greater than the best score SBEST (step 940), SFINAL is recorded as the new SBEST (step 945).

All of the game modes may incorporate music, voice, or other sounds from the speaker 200, flashes from the light 190, or a display of time or score from the alphanumeric display (not shown).

Referring to FIGS. 10-13, a target game 1000 permits two players to play target games "head-to-head" (that is, to play at the same time in competition with each other). The target game 1000 includes a base 1005, a target area 1010, a first launch area 1015, and a second launch area 1020. The target area 1010 is attached to the base 1005 such that the target area 1010 and the base 1005 define an obtuse angle. The target area 1010 includes a first target region 1025 and a second target region 1030. Similar to the target area 110 described with respect to FIG. 1, the first target region 1025 includes a series of concentric, upstanding, circular walls 1026, 1027, and 1028 that define, respectively, target sections 1035, 1036, and 1037. The second target region 1030 also includes a series of concentric, upstanding, circular walls 1031, 1032, and 1033 that define, respectively, target sections 1040, 1041, and 1042. each of the target sections 1035, 1036, 1037, 1040, 1041, and 1042 includes a corresponding one of apertures 1050-1055. The base 1005 and the target area 1010 are made of plastic or other suitable rigid materials.

The base 1005 includes a surface 1060 in front of the target area 1010 to which the first launch area 1015 and the second launch area 1020 are attached. The first launch area 1015 includes an elastic material 1017, such as rubber or nylon, stretched over a plastic ring 1019. The second launch area 1020 also includes an elastic material 1022, such as rubber or nylon, stretched over a plastic ring 1024. The elastic materials 1017 and 1022 form, in effect, a trampoline in each of the launch areas 1015 and 1020.

The game 1000 also includes playing pieces (not shown). The playing pieces 120 described with respect to FIG. 1 may be used. Playing pieces are made of a firm material, such as metal or plastic, that can be bounced off the elastic launch area 1015 or the elastic launch area 1020 into the target area 1010.

The game 1000 may be sized for table-top play such that, for example, the overall size is less than 2 feet long, less than 1 foot high, and less than 1 foot wide. In one implementation, the game 1000 is approximately 12 inches long, approximately 12 inches wide, and approximately 6.5 inches high.

Game play generally entails a first player bouncing playing pieces from the first launch area 1015 into the first target region 1025 and a second player bouncing playing pieces from the second launch area 1020 into the second target region 1030. In one implementation, the first player receives a set number of points for hitting one of the target sections 1035, 1036, and 1037, while the second player receives a set number of points for hitting one of the target sections 1040, 1041, and 1042. Higher points can be assigned for smaller target sections. For example, in one implementation, the first player or second player, respectively, receives three points for hitting a center section 1035 or 1040, two points for hitting a middle section 1036 or 1041, and one point for hitting an outer section 1037 or 1042.

In the example shown, the game 1000 is configured such that a playing piece tossed onto the first launch area 1015 is directed toward the first target region 1025 and a playing piece tossed onto the second launch area 1020 is directed toward the second target region 1030. To that end, the first launch area 1015 and the second launch area 1020 each define an obtuse angle with the base 1005, with the first launch area 1015 being tilted toward or in the direction of the first target region 1025 and the second launch area 1020 being tilted toward or in the direction of the second target region 1030. With the first launch area 1015 being tilted toward or in the direction of the first target region 1025 and the second launch area 1020 being tilted toward or in the direction of the second target region 1030, a playing piece launched from the first launch area 1015 may be more likely to hit the first target region 1025 than the second target region 1030, and a playing piece launched from the second launch area 1020 may be more likely to hit the second target region 1030 than the first target region 1025.

Also, the game 1000 is configured such that the paths of playing pieces cross. As shown, first launch area 1015 is positioned diagonally across from the first target region 1025 and the second launch area 1020 is positioned diagonally across from the second target region 1030 such that the path between first launch area 1015 to first target area 1025 crosses the path between the second launch area 1020 and the second target region 1030. In this arrangement, the path of a playing piece launched from the first launch area 1015 toward the first target region 1025 crosses the path of a playing piece launched from the second launch area 1020 toward the second target region 1030. As a result, a piece launched from the first launch area 1015 toward the first target region 1025 may collide with a piece launched from the second launch area 1020 toward the second target region 1030

After a playing piece strikes a target section 1035, 1036, 1037, 1040, 1041, or 1042, the corresponding wall 1026, 1027, 1028, 1031, 1032, or 1033 defining the target section guides the playing piece into the corresponding aperture 1050, 1051, 1052, 1053, 1054, or 1055. For instance, after a playing piece strikes target section 1035, the wall 1026 guides the playing piece into aperture 1050.

An optical sensor system, such as optical sensor system 300 described with respect to FIG. 3, may be used to detect the passage of playing pieces through the apertures 1050-1055, and provide signals used by the game 1000 to increase the score accordingly. Thus, for example, similar to detection system 300 in game 100, an optical detector may be positioned next to each of apertures 1050-1055. A first optical emitter may be positioned with respect to apertures 1050-1052 such that a beam from the first optical emitter covers apertures 1050-1052 and is received by the optical detectors associated with those apertures. Likewise, a second optical emitter may be position with respect to apertures 1053-1055 such that a beam from the second optical emitter covers apertures 1053-1055 and is received by the optical detectors associated with those apertures. The passage of a playing piece through an aperture 1050, 1051, 1052, 1053, 1054, or 1055 momentarily interrupts the beam covering the aperture. This momentary interruption is detected by the corresponding detector, which provides signals used by the game 1000 as appropriate.

The game 1000 further includes a passage (not shown), similar to passage 150 described with respect to FIG. 1, associated with the first target region 1025. A tray 1065 is attached to the base 1005 such that the tray 1065 engages the passage associated with the first target region 1025. The passage is connected to the apertures 1050-1052. As a result, playing pieces that enter the apertures 1050-1052 move through the passage to the tray 1065. The tray 1065 holds playing pieces for the first player during game play and may include a cover (not shown) to hold pieces securely while the game is not in use. In one implementation, the passage is a single, common channel extending under all of the apertures 1050-1052. When a playing piece passes through any of apertures 1050-1052 the playing piece enters the signal channel and moves through the passage to the tray 1065. Because the passage is a single channel extending under all of the apertures 1050-1052, separate passages for each aperture are not needed and manufacturing costs may be reduced.

The game 1000 also includes a passage (not shown), similar to passage 150 described with respect to FIG. 1, associated with the second target region 1030. A tray 1070 is attached to the base 1005 such that the tray 1070 engages the passage associated with the second target region 1030. The passage is connected to the apertures 1053-1055. As a result, playing pieces that enter the apertures 1053-1055 move through the passage to the tray 1070. The tray 1070 holds playing pieces for the second player during game play and may include a cover (not shown) to hold pieces securely while the game is not in use. In one implementation, the passage is a single, common channel extending under all of the apertures 1053-1055. When a playing piece passes through any of apertures 1053-1055 the playing piece enters the single channel and moves through the passage to the tray 1070. Because the passage is a single channel extending under all of the apertures 1053-1055, separate passages for each aperture are not needed and manufacturing costs may be reduced.

In one implementation, the passage associated with the first target region 1025 may cross the passage associated with the second target region 1030. In this implementation, playing pieces traveling from the first target region 1025 to the tray 1065 cross paths and may collide with playing pieces traveling from the second target region 1030 to the tray 1070. In another implementation, the passage associated with the first target region 1025 may be located above or below the passage associated with the second target region 1030 such that they do not cross. In this implementation, playing pieces traveling from the first target region 1025 to the tray 1065 cannot collide with playing pieces traveling from the second target region 1030 to the tray 1070.

In the event that a playing piece misses a target section 1035, 1036, 1037, 1040, 1041, or 1042, the playing piece may fall back and strike surface 1060. Surface 1060 is oriented so that the playing piece that misses the target sections 1035, 1036, 1037, 1040, 1041, and 1042 and falls back to strike the surface 1060 will return to either the tray 1065 or the tray 1070.

The game 1000 also includes control buttons 1080-1084 mounted at the top of target area 1010. The control buttons 1080-1084 allow a player to control aspects of the game 1000. The ON/GAME button 1080 activates the game when initially pressed and is used subsequently to select one of several game modes (which are further described below) for play. Pressing the SCORE button 1081 causes the score to be announced. Pressing the SOUND button 1082 adjusts the speaker volume. Pressing the OFF button 1083 turns the game off. Pressing the RESET button 1084 erases the game's memory.

The game 1000 further includes visual feedback mechanisms in the form of lights 1090 and 1095 (or, in other implementations, alphanumeric displays) associated, respectively, with the first and second target regions 1025 and 1030, and mounted at the top of the first and second target regions 1025 and 1030. The game 1000 also includes a speaker 1100 (FIG. 11) that is mounted at the back of the target area 1010. The speaker 1100 (or other audio feedback mechanism) is used to emit voice, music, or other sounds. These audio and visual feedback mechanisms are used to inform the player of certain aspects of the game, such as game mode selection, current time or score, best time or score, the status of the game, or the status of one player's position with respect to the other player.

To provide electrical power and control of the game 1000, the game 1000 includes a control system similar to that described with respect to FIG. 5. In one implementation, the controller 565 described with respect to FIG. 5 is modified to include inputs and outputs for a light, an IR emitter, and three IR detectors for each of the first target region 1025 and the second target region 1030.

Figure 14:
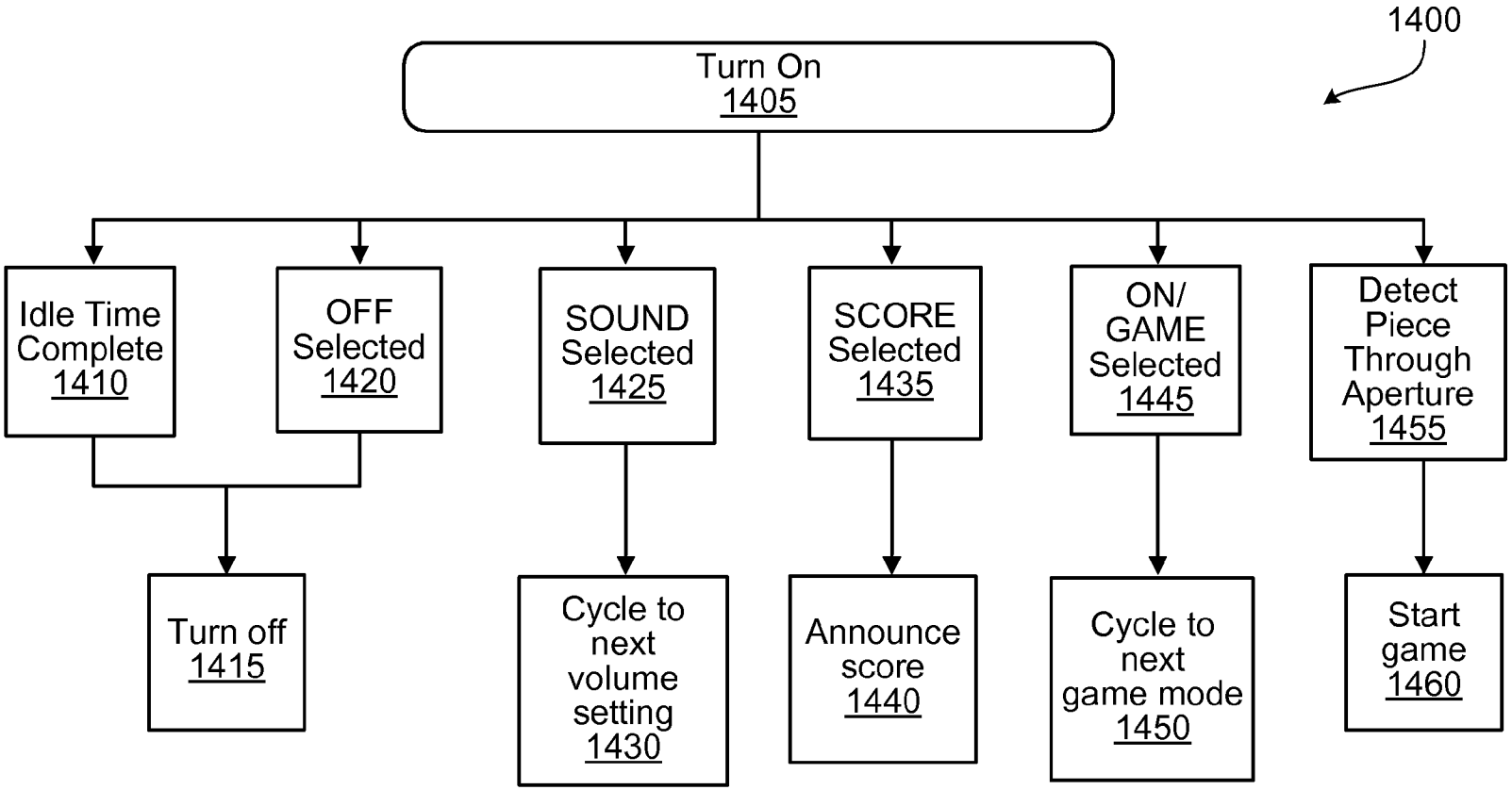
FIGS. 14-19 are left and right side views, respectively, of the target game.

Referring to FIG. 14, the control system of the game 1000 implements a procedure 1400 to control game operation. Initially, the game 1000 is turned on (1405) when the ON/GAME button 1080 is pressed. The controller determines if any of the switches or optical detectors have been activated within a set amount of time (for example, 60 seconds) (1410) and, if not, the controller causes the game 1000 to automatically turn off (1415). Similarly, if the OFF button 1083 is pressed (1420), the controller causes the game to turn off (1415).

When the SOUND button 1082 is selected (1425), the controller cycles to the next volume level (1430). The volume levels include, for example, high, low, and off.

When the SCORE button 1081 is selected (1435), the controller causes the score of the most recent game played to be announced by speaker 1100 (1440).

When the ON/GAME button 1080 is selected (1445), the controller cycles to the next game mode (1450). Game 1000 includes five game modes, a 10 POINT LEAD game mode, a REPEATER game mode, a WINNER TAKE ALL game mode, a TOTAL CONTROL game mode, and a COMBO game mode.

The objective of the 10 POINT LEAD game mode is that players compete until one player has a lead of a certain number of points, e.g. ten points, over the other player.

The objective of the REPEATER game mode is to score points by hitting a variable target randomly assigned by the game 1000. A player wins by scoring a certain number of points, e.g. fifty points, before the other player.

The objective of the WINNER TAKE ALL game mode is to garner the most saved points by hitting every fifth bulls-eye. The game 1000 stores the points scored by either of the players hitting target sections other than the bulls-eye and counts the total number of bulls-eyes scored. Every fifth bulls-eye, the player who hit that bullseye is awarded the saved points and the game stops when the total number of bullseyes reached a certain number, e.g., thirty bullseyes.

The objective of the TOTAL CONTROL game mode is to score the most points in a certain amount of time. A player may only score points when that player has control of the targets. A player gains control by hitting a bulls-eye and loses control when the other player hits a bullseye. The game ends after a certain amount of time, e.g., thirty seconds, which may increase with each bullseye hit, e.g. one second per bullseye.

Lastly, the objective of the COMBO game mode is to score points by hitting a combination of targets randomly set by the game 1000. When a player completes a combination, the game 1000 awards that player a certain number of points and sets a new combination. The player with the most points after a certain amount of time wins. Hitting a combination may add a certain amount of time, e.g. three seconds, to the game time.

When an optical detector signals to the controller that a playing piece has passed through one of apertures 1050-1055 (1455), then a game according to the presently selected game mode is initiated (1460).

Figure 15:
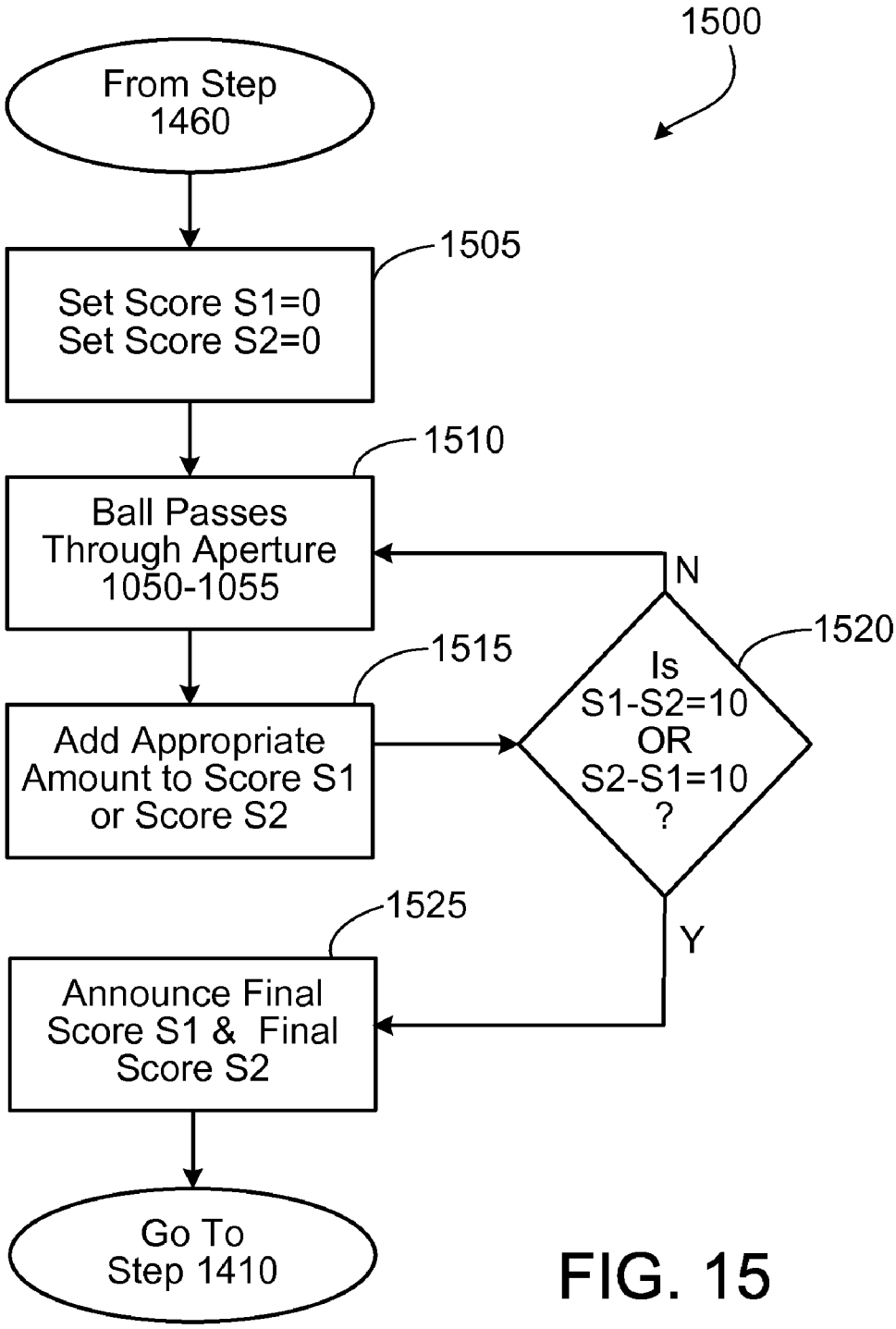

Referring to FIG. 15, a process 1500 is performed by the controller to implement the 10 POINT LEAD game mode. Initially, a score S1 for player one and a score S2 for player two are set to zero (1505). The first player bounces playing pieces from the first launch area 1015 into the first target region 1025 and the second player bounces playing pieces from the second launch area 1020 into the second target region 1030. If an optical sensor indicates a playing piece has passed through apertures 1050-1055 (1510), the appropriate amount (e.g., 3 pints, 2 points, or 1 point) is added to the score S1 or score S2 depending on which aperture the playing piece passed through (1515). For example, the center apertures 1050 and 1053 may be worth three points, the middle apertures 1051 and 1054 may be worth 2 points, and the outer apertures 1052 and 1055 may be worth 1 point. The appropriate amount is added to the score S1 if the playing piece passes through an aperture (e.g., 1050, 1051, or 1052) located in the first target region 1025 and the appropriate amount is added to the score S2 if the playing piece passes through an aperture (e.g., 1053, 1054, or 1055) located in the second target region 1030. The game continues until the difference between the score S1 and the score S2 equals ten or the difference between the score S2 and the score S1 equals ten (1520). At that point, the final score for S1 and S2 is announced (1525), with the winner being the person with the highest score. The lowest score may be announced first.

Figure 16:
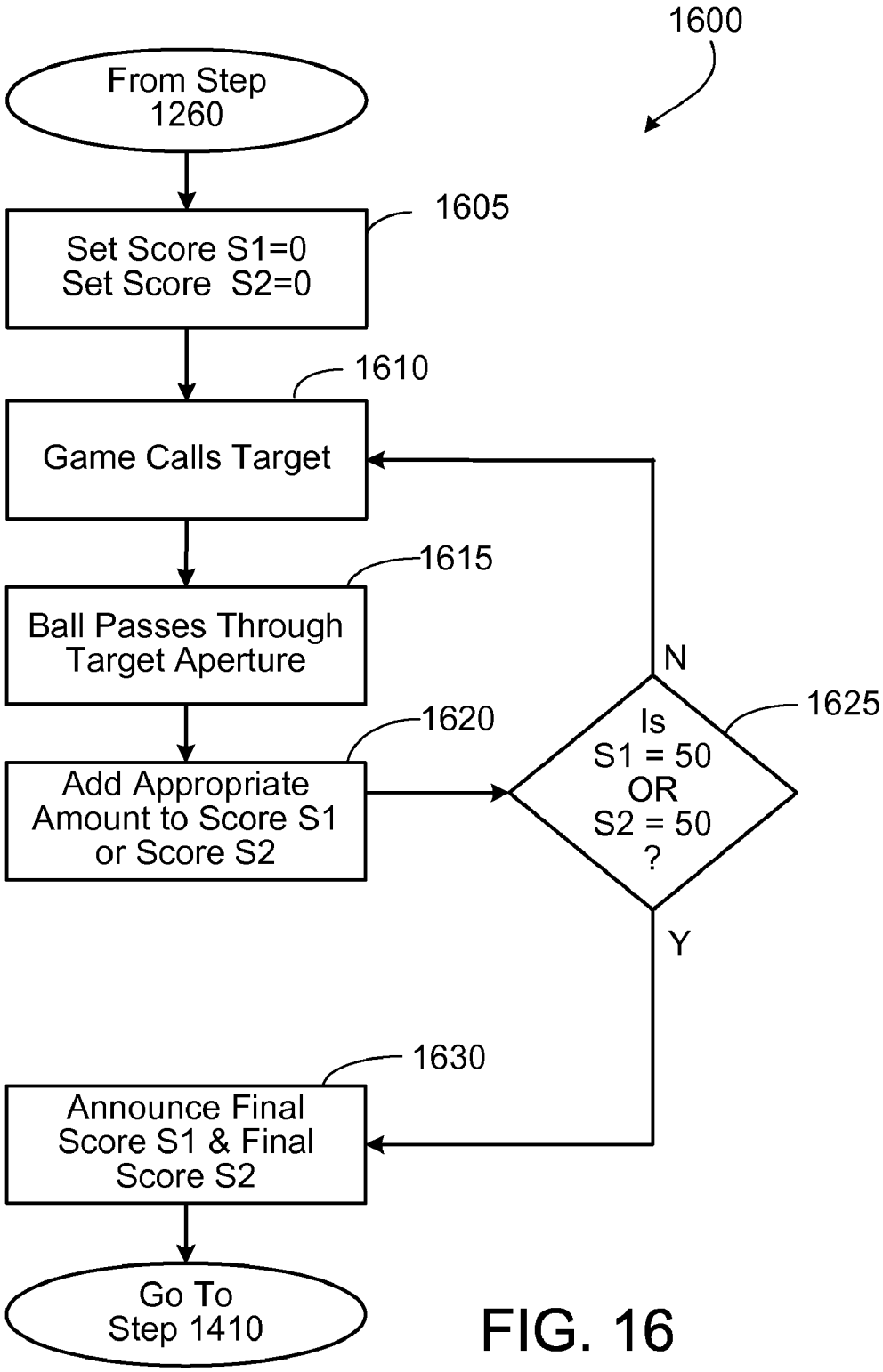

Referring to FIG. 16, a process 1600 is performed by the controller to implement the REPEATER game mode. When the game starts, a score S1 for player one and a score S2 for player two are set to zero (1605). The game 1000 uses speaker 1100 to designate a target (1610) (e.g., the outer target/aperture). The first player bounces playing pieces from the first launch area 1015 into the first target region 1025 and the second player bounces playing pieces from the second launch area 1020 into the second target region 1030. If an optical sensor indicates a playing piece has passed through the designated target aperture (1615), the corresponding amount of points (e.g., 3 points of center aperture, 2 points for middle aperture, or 1 point for the outer aperture) is added to the score S1 or the score S2 (1620). The corresponding amount is added to the score S1 if the playing piece passes through the designated target aperture located in the first target region 1025 and the corresponding amount is added to the score S2 if the playing piece passes through the designated target aperture located in the second target region 1030. The game continues until the score S1 or the score S2 has reached fifty points (1625). At that point, the final score for S1 and S2 is announced (1630), with the winner being the one with the highest score. The game 1000 may call a new target each time a player hits the prior target or the game 1000 may call a new target randomly as play continues.

Figure 17:
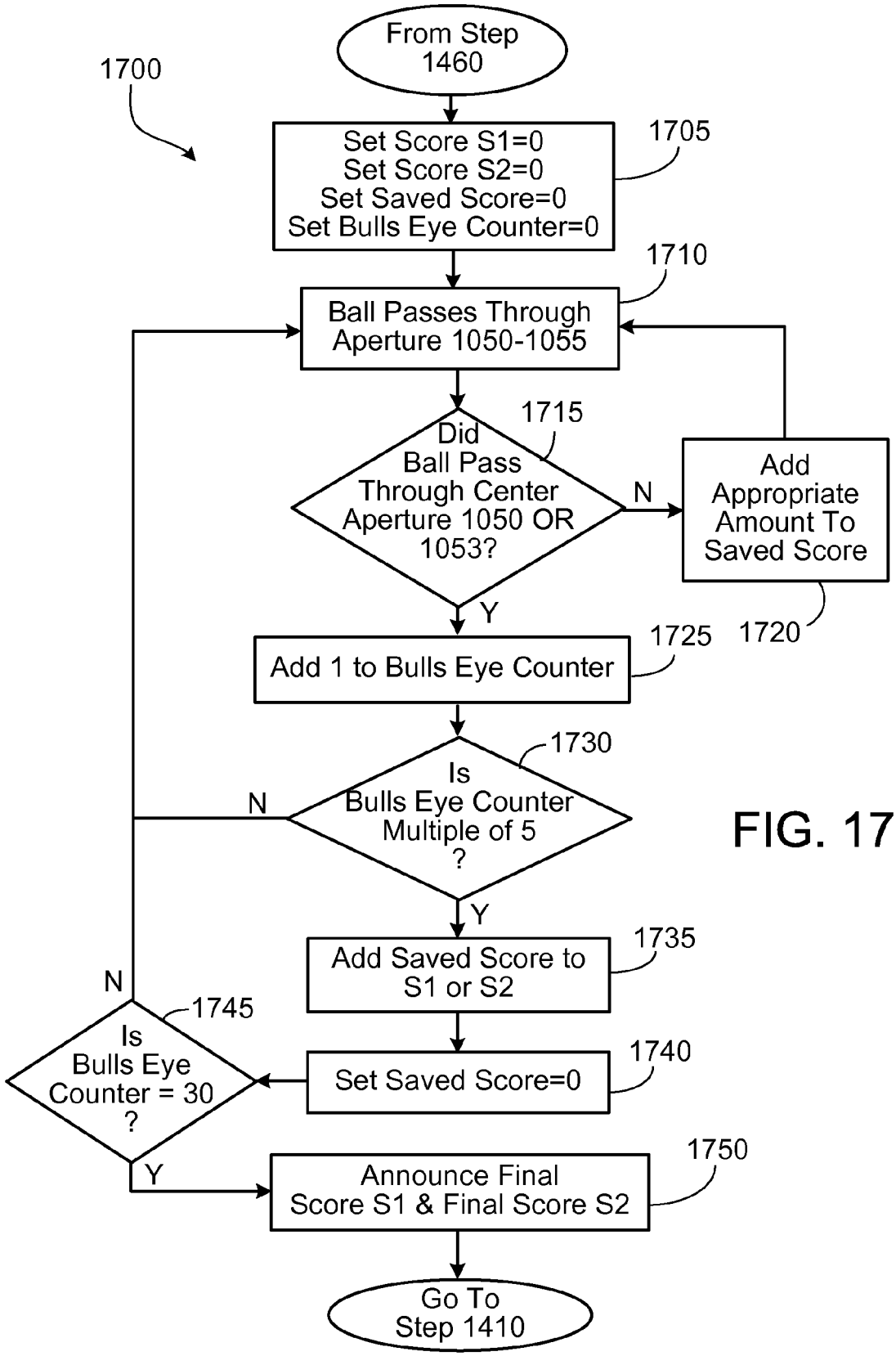

Referring to FIG. 17, a process 1700 is performed by the controller to implement the WINNER TAKE ALL game mode. Initially, a score S1, a score S2, a Saved Score, and a Bulls-Eye Counter are set to zero (1705). The first player bounces playing pieces from the first launch area 1015 into the first target region 1025 and the second player bounces playing pieces from the second launch area 1020 into the second target region 1030. If an optical sensor indicates a playing piece has passed through an one of apertures 1050-1055 (1710), the controller determines if the ball passed through a center aperture 1050 or 1053 (1715). If not, the appropriate amount (e.g., 2 points for middle aperture or 1 point for outer aperture) is added to the saved score (1720). If so, the BullsEye Counter is incremented by one (1725). If the BullsEye Counter is a multiple of five (1730), the Saved Score is added to score S1 or score S2 (step 1735) and the Saved Score is set to zero (1740). In one implementation, the Saved Score is added to the score S1 if the playing piece passes through the center aperture 1050 located in the first target region 1025 and the Saved Score is added to the score S2 if the playing piece passes through the center aperture 1053 located in the second target region 1030. The game continues until the BullsEye Counter equals thirty (1745). At that point, the final score for S1 and S2 is announced (1750), with the winner being the person with the highest score.

Figure 18:
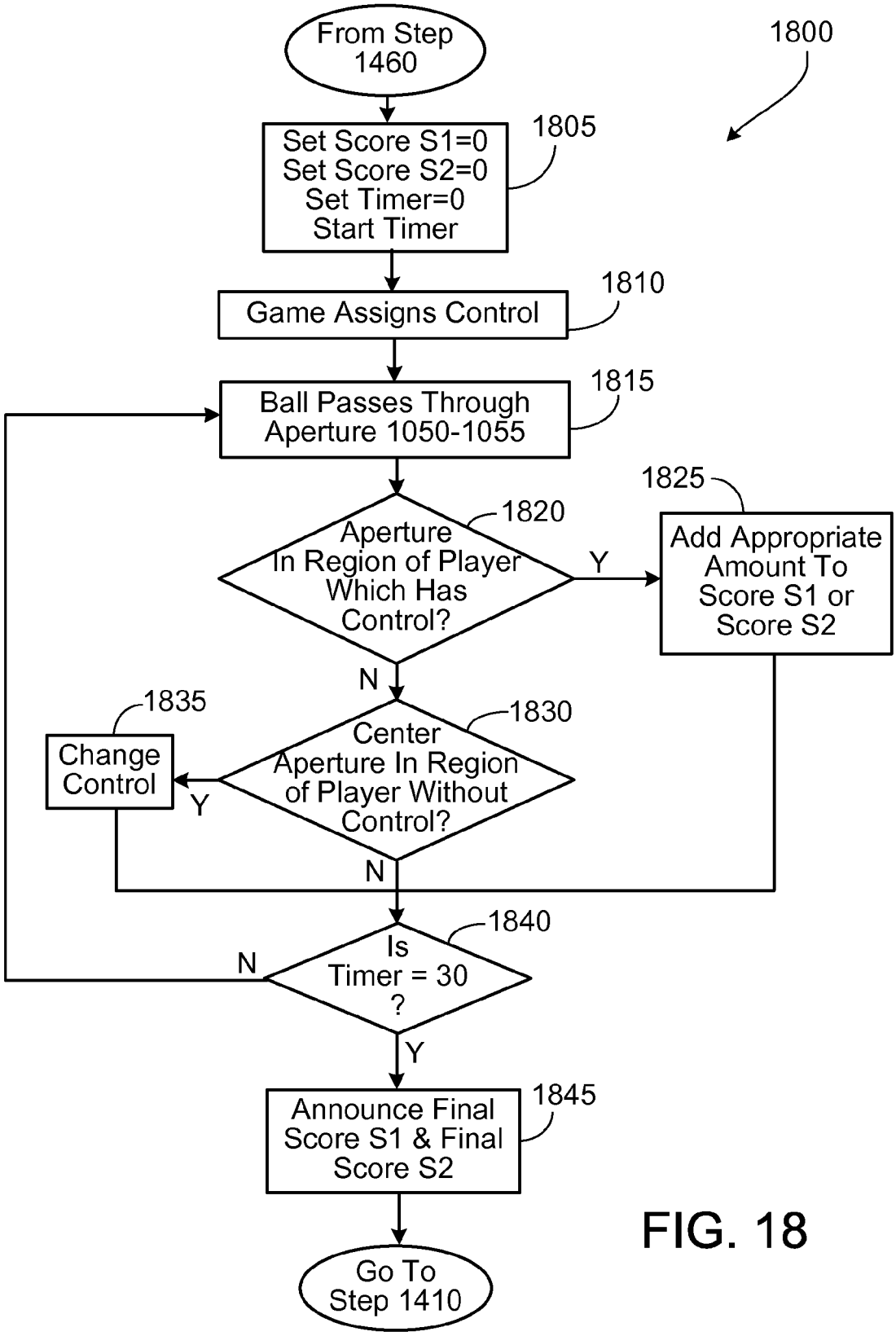

Referring to FIG. 18, a process 1800 is performed by the controller to implement the TOTAL CONTROL game mode. Initially, a score S1, a score S2, and a timer are set to zero, and the timer is started (1805). In addition, the game 1000 assigns control to one of the players (1810). In one implementation, the game 1000 assigns control based on which player first passes a playing piece through the center aperture associated with that player.

The first player continues to bounce playing pieces from the first launch area 1015 into the first target region 1025, and the second player continues to bounce playing pieces from the second launch area 1020 into the second target region 1030. If an optical sensor indicates a ball has passed through one of apertures 1050-1055 (1815), the controller determines if the ball passed through an aperture in the target region associated with the player which has control (1820). If so, the appropriate amount (e.g., 3 points, 2 points, or 1 point) is added to score S1 or score S2 based on which player has control (1825). If not, the controller determines if the ball passed through the center aperture in the target region associated with the player without control (1830). If so, the game 1000 changes which player has control (1835). The game continues until the timer equals thirty (1840). In one implementation, the time at which the game stops is increased by one second each time a player passes a playing piece through a center aperture. At that point, the final score for S1 and S2 is announced (1845).

Figure 19:
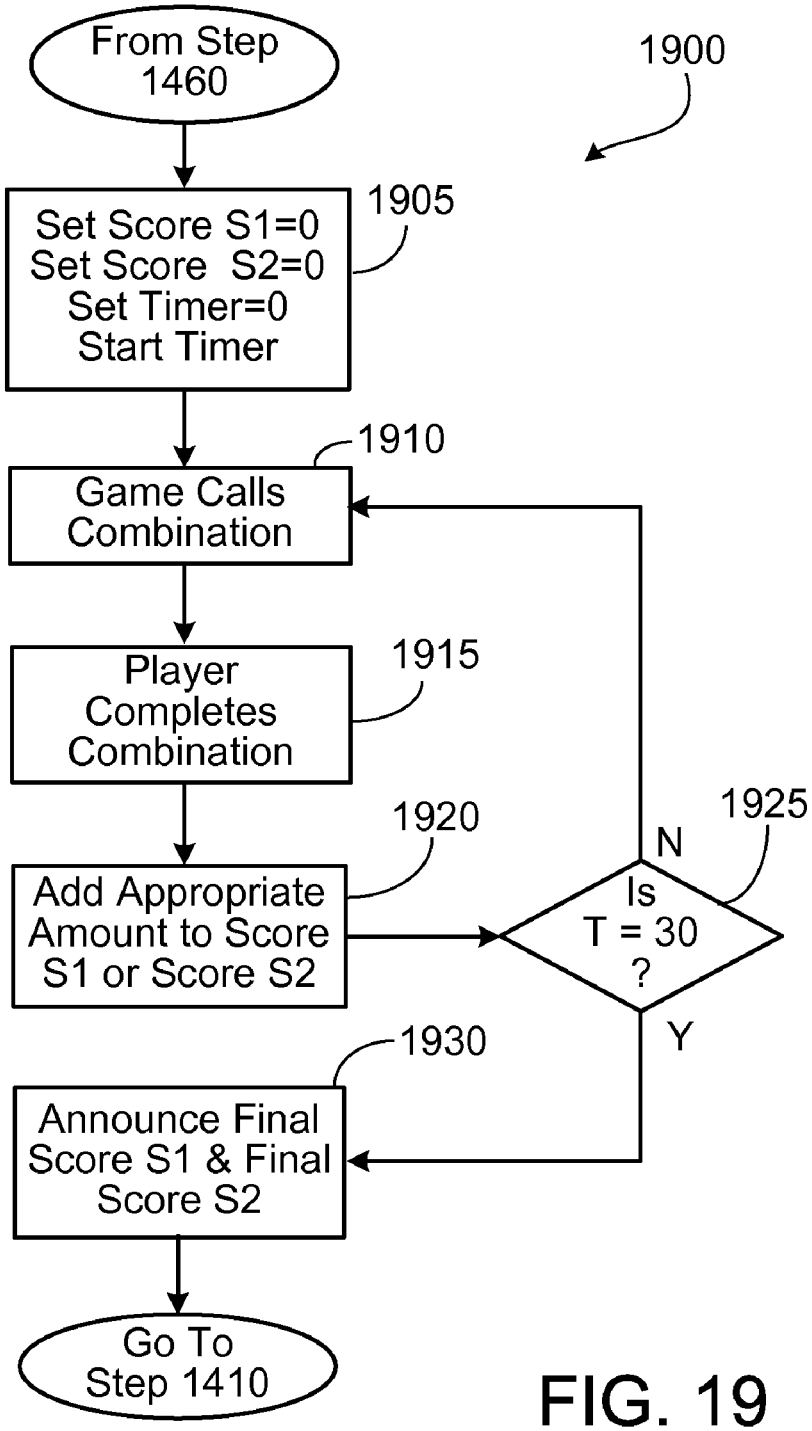

Referring to FIG. 19, a process 1900 is performed by the controller to implement the COMBO game mode. When the game starts, a score S1, a score S2, and a timer are set to zero, and the timer is started (1905). The game 1000 uses speaker 1100 to designate a combination of targets (1910), e.g., three bullseyes (center target), or three outer targets. If a player obtains the designated combination (1915), a corresponding amount of points (e.g., 9 points for three bullseyes or 3 points for three outer apertures) is added to the score S1 or the score S2 (1920). The appropriate amount is added to the score S1 if player one has completed the combination and the appropriate amount is added to the score S2 if player two has completed the combination. The game continues until the timer equals thirty (1925). In one implementation, the time when the game stops is increased by three seconds each time a player completes a combination. At that point, the final score for S1 and S2 is announced (1930).

All of the game modes may incorporate music, voice, or other sounds from the speaker 1110,, flashes from the lights 1090 and 1095, or a display of time or score from the alphanumeric display (not shown). For example, during the 10 POINT LEAD game mode and the REPEATER game mode, speaker 1100 and lights 1090 and 1095 may be used to indicate the player that is ahead in points, and to call out the score for the player who is ahead. During the WINNER TAKE ALL game mode, speaker 1100 and lights 1090 and 1095 may be used to indicate the player who is ahead, to indicate the player who got the saved points, and to call out the amount of the saved points. During the TOTAL CONTROL game mode, speaker 1100 and lights 1090 and 1095 may be used to indicate which player has control and to call out the score for the player who has control. During the COMBO game mode, speaker 1100 and lights 1090 and 1095 may be used to indicate which player is ahead, which player got the designated combination, and to call out the score of the player who got the designated combination.

Although, in the implementations of game 1000 discussed above, the target area 1010 has been described as having a first target region 1025 and a second target region 1030, with the object being to have the players each aim for a respective one of the target regions 1025 and 1030, the target area 1010 need not be separated into regions. Instead, a single target region with a single set of apertures and upstanding walls may be used, and the players may both aim at the single target region. If the target area 1010 is not separated in regions, the optical sensor system of game 1000 may be configured to distinguish between playing pieces launched by a first player and playing pieces launched by a second player.

Figure 20:
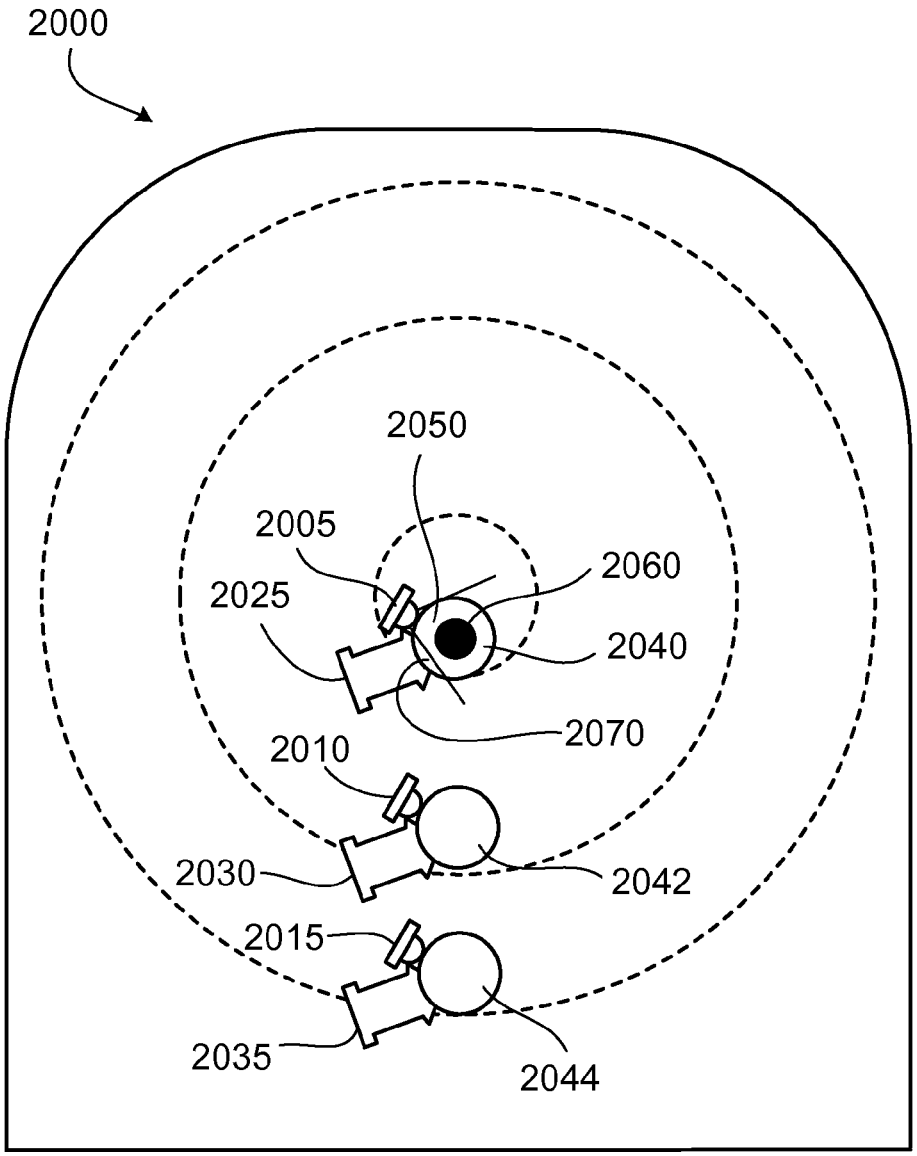
FIG. 20 is a plan view showing an optical detection system.

Referring to FIG. 20, an optical sensor system 2000 detects the passage of playing pieces through the apertures 2040, 2042, and 2044, detects whether the playing pieces passing through apertures 2040, 2042, and 2044 are from a first player or a second player, and provides signals used by the game to implement game play. The optical sensor system 2000 includes three optical emitters 2005, 2010, and 2015 (e.g., infrared light emitters) that each emit an optical (e.g., infrared) beam. Each optical emitter 2005, 2010, or 2015 is positioned next to a corresponding aperture 2040, 2042, or 2044 such that an optical beam emitted from the optical emitter 2005, 2010, or 2015 passes across the corresponding aperture 2040, 2042, or 2044. For example, optical emitter 2005 emits optical beam 2050 that passes across aperture 2040. The optical sensor system also includes three optical (e.g., infrared) sensors 2025, 2030, and 2035 that detect the presence and intensity of an optical beam. Each optical sensor 2025, 2030, or 2035 is positioned next to (e.g., on the same side of an aperture as) a corresponding optical emitter 2005, 2010, or 2015 such that, when a playing piece passes through a corresponding aperture 2040, 2042, or 2044, the optical sensor 2025, 2030, or 2035 senses a reflected optical (e.g., infrared) beam caused by the playing piece reflecting the optical beam emitted from the corresponding optical emitter 2005, 2010, or 2015. For example, when a playing piece 2060 passes through aperture 2040 the playing piece 2060 reflects optical beam 2050 to create a reflected optical beam 2070, which optical sensor 2025 senses. Upon sensing a reflected optical beam, the optical sensor 2025, 2030, or 2035 detects that a playing piece has passed through the corresponding aperture 2040, 2042, or 2044.

In addition, the optical sensor 2025, 2030, or 2035 senses the intensity of the reflected optical beam to distinguish between playing pieces associated with a first player and playing pieces associated with a second player. If playing pieces associated with a first player are of a different color than playing pieces associated with a second player, the intensity of the reflected optical beam produced by the playing pieces associated with the first player will be different than the intensity of the reflected optical beam produced by the playing pieces associated with the second player. For example, if a first player uses white playing pieces and a second player uses red playing pieces, the playing pieces launched by the first player will produce a reflected optical beam with a higher intensity than a reflected optical beam produced by the playing pieces launched by the second player. Because the playing pieces associated with a first player are of a different color than the playing pieces associated with a second player, the optical sensors 2025, 2030, and 2035 may distinguish between playing pieces launched by the first player and playing pieces launched by the second player based on the difference in intensity of the respective reflected optical beams. After detecting the presence and intensity of an optical beam, the optical sensor 2025, 2030, or 2035 signals the game to control game play accordingly.

Additionally, in an implementation that uses a single target region, the playing pieces of the first player may have a diameter that is different than the diameter of the playing pieces used by the second player. The return passages then may include an area configured to allow the smaller diameter playing pieces through such that they are directed to one return tray (e.g., tray 1070), while not allowing the larger diameter pieces through such that they are directed to the other return tray (e.g., tray 1065). Because of this, the first player's playing pieces may be returned to one return tray, while the second player's playing pieces are returned to another return tray.

Furthermore, a detection system that distinguishes between playing pieces associated with a first player and playing pieces associated with a second player may be used in the implementation of game 1000 shown in FIGS. 10-13. In this case, the detection system may be used to insure that the first player only receives points for playing pieces launched from the first launch area 1015 that hit one of the target sections 1035-1037 and that the second player only receives points for playing pieces launched from the second launch area 1020 that hit one of the target sections 1040-1042. Otherwise, if the detection system does not distinguish between the playing pieces, then the first player may receive points for any playing piece hitting one of the target sections 1035-1037 and the second player may receive points for any playing piece hitting one of the target sections 1040-1042, regardless of whether the playing piece was launched from the first launch area 1015 or the second launch area 1020. The playing pieces associated with the first player may be a different color than playing pieces associated with the second player.

A number of implementations have been described. Nevertheless, it will be understood that various modifications may be made. For example, sensors other than optical sensors (e.g., magnetic or mechanical sensors) may be used to detect passage of a playing piece through an aperture.

Also, in other implementations, the launch area(s) may be made of a firm material, such as plastic or metal, and the playing pieces may be made of an elastic material, such as rubber, such that the elastic playing pieces bounce off the firm launch area(s) into the target area(s).

Other game sizes may be used. For instance, larger versions may be implemented for play at, for example, an amusement park.

Some implementations also may allow one game unit be electronically connected to other game units for multiple players to play simultaneously.

Other implementations are within the scope of the following claims.

What is claimed is:

1. A game comprising:

a base unit;

a target area attached to the base unit and having multiple target sections, each target section including an aperture;

a first launch area attached to the base unit and adapted for receiving a first playing piece tossed onto the first launch area by a user such that the first playing piece bounces into one of the multiple target sections and passes through the corresponding aperture of the target section;

a second launch area attached to the base unit and adapted for receiving a second playing piece tossed onto the second launch area by a user such that the second playing piece bounces into one of the multiple target sections and passes through the corresponding aperture of the target section a detection system configured to detect which one of the apertures the first playing piece passed through and which one of the apertures the second playing piece passed through; and an electronic controller configured to receive one or more signals from the detection system and to control game play based on the one or more signals, the one or more signals indicating which aperture the first playing piece passed through and which aperture the second playing piece passed through.

2. The game of claim 1 wherein the multiple target sections are arranged in a first target region and a second target region, the first launch area is adapted for receiving the first playing piece tossed onto the first launch area by a user such that the first playing piece bounces into one of the multiple target sections in the first target region, and the second launch area is adapted for receiving the second playing piece tossed onto the second launch area by a user such that the second playing piece bounces into one of the multiple target sections in the second target region.

3. The game of claim 1 wherein the target area further comprises a series of concentric, upstanding, circular walls, each circular wall defining one of the multiple target sections.

4. The game of claim 1 wherein the base unit, the target area, the first launch area and the second launch area are sized for table-top play of the game.

5. The game of claim 1, wherein the electronic controller is configured to control game play according to a game mode selected by a player of the game, the game further comprising an input operatively connected to the electronic controller to allow the player to select one of at least two game modes, wherein each of the two game modes has a different objective for game play.

6. A game comprising:

a base unit;

a target area attached to the base unit and having multiple target sections, each target section including an aperture;

means for receiving a first playing piece tossed by a user such that the first playing piece bounces into one of the multiple target sections and passes through the corresponding aperture of the target section;

means for receiving a second playing piece tossed by a user such that the second playing piece bounces into one of the multiple target sections and passes through the corresponding aperture of the target section;

means for detecting which one of the apertures the first playing piece passed through and which one of the apertures the second playing piece passed through; and means for controlling game play based on which aperture the first playing piece passed through and which aperture the second playing piece passed through.

7. The game of claim 6 wherein the multiple target sections are arranged in a first target region and a second target region, the means for receiving the first playing piece is adapted such that the first playing piece bounces into one of the multiple target sections in the first target region, and the means for receiving the second playing piece is adapted such that the second playing piece bounces into one of the multiple target sections in the second target region.

8. The game of claim 6 wherein the target area further comprises a series of concentric, upstanding, circular walls, each circular wall defining one of the multiple target sections.

9. The game of claim 6 wherein the base unit, the target area, the means for receiving the first playing piece, and the means for receiving the second playing piece are sized for table-top play of the game.

10. The game of claim 6, wherein the means for controlling game play is configured to control game play according to a game mode selected by a player of the game, the game further comprising an input operatively connected to the electronic controller to allow the player to select one of at least two game modes, wherein each of the two game modes has a different objective for game play.

11. A game comprising:

a base unit;

a first target region attached to the base unit and including a first set of multiple target sections, each target section in the first set including an aperture;

a second target region attached to the base unit and including a second set of multiple target sections, each target section in the second set including an aperture;

a first launch area attached to the base unit and adapted for receiving a first playing piece tossed onto the first launch area by a user such that the first playing piece bounces toward the first target region;

a second launch area attached to the base unit and adapted for receiving a second playing piece tossed onto the second launch area by a user such that the second playing piece bounces toward the second target region;

a detection system configured to detect when the first playing piece passes through one of the apertures in the first target region and to detect when the second playing piece passes through one of the apertures in the second target region; and an electronic controller configured to receive one or more signals from the detection system and to control game play based on the one or more signals, the one or more signals indicating when the first playing piece passes through one of the apertures in the first target region and when the second playing piece passes through one of the apertures in the second target region.

12. The game of claim 11 wherein the first target region includes a series of concentric, upstanding, circular walls, each circular wall defining one of the multiple target sections in the first set and the second target region includes a series of concentric, upstanding, circular walls, each circular wall defining one of the multiple target sections in the second set.

13. The game of claim 11 further comprising:

an input configured to allow a player to select one of at least two game modes, where each of the two game modes has a different objective for game play.

14. The game of claim 13 wherein each one of the target sections is assigned a point value and the objective of one of the at least two game modes is for a first player to lead a second player by a specified number of points.

15. The game of claim 13 wherein the objective of one of the at least two game modes is to bounce a playing piece into a target section selected by the controller.

16. The game of claim 13 wherein the objective of one of the at least two game modes is to obtain points by hitting a selected one of the target regions.

17. The game of claim 13 wherein the objective of one of the at least two game modes is to bounce a playing piece into a particular target section to obtain control of the game and, while in control, to obtain points by bouncing a playing piece into one of the target sections.

18. The game of claim 13 wherein the objective of one of the at least two game modes is to bounce multiple playing pieces into a selected combination of the target sections.

19. The game of claim 11 wherein the first launch area, the second launch area, the first target region, and the second target region are arranged such that a path of the first playing piece bounced from the first launch area toward the first target region crosses the path of the second playing piece bounced from the second launch area toward the second target region.

20. The game of claim 19 wherein the first launch area is positioned diagonally across from the first target region and the second launch area is positioned diagonally across from the second target region such that a path between the first launch area to the first target area crosses a path between the second launch area and the second target region.

* * * * *